US006452583B1

(12) United States Patent
Takeuchi et al.

(10) Patent No.: US 6,452,583 B1
(45) Date of Patent: Sep. 17, 2002

(54) DISPLAY-DRIVING DEVICE AND DISPLAY-DRIVING METHOD

(75) Inventors: Yukihisa Takeuchi, Nishikamo-gun; Tsutomu Nanataki, Toyoake; Iwao Ohwada, Nagoya; Takayoshi Akao, Kasugai, all of (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/115,978

(22) Filed: Jul. 15, 1998

(30) Foreign Application Priority Data

Jul. 18, 1997 (JP) ..... 9-194519

(51) Int. Cl.[7] ..... G09G 3/34
(52) U.S. Cl. ..... 345/108; 348/771
(58) Field of Search ..... 345/148; 340/783; 348/771; 359/869, 292; 385/115, 2; 350/269

(56) References Cited

U.S. PATENT DOCUMENTS

| | | | | |
|---|---|---|---|---|
| 2,565,514 A | * | 8/1951 | Pajes | |
| 2,997,922 A | * | 8/1961 | Kaprelian | |
| 3,376,092 A | * | 4/1968 | Kushner et al. | |
| 3,698,793 A | | 10/1972 | Tellerman | |
| 3,812,490 A | | 5/1974 | Goodrich | |
| 4,113,360 A | | 9/1978 | Baur et al. | |
| 4,234,245 A | * | 11/1980 | Toda et al. | 350/269 |
| 5,045,847 A | * | 9/1991 | Tarui et al. | 340/783 |
| 5,106,181 A | * | 4/1992 | Rockwell, III | 385/2 |
| 5,319,491 A | * | 6/1994 | Selbrede | |
| 5,452,024 A | * | 9/1995 | Sampsell | 348/755 |
| 5,521,746 A | * | 5/1996 | Engle | 359/292 |
| 5,563,977 A | * | 10/1996 | Cassarly et al. | 385/115 |
| 5,636,072 A | * | 6/1997 | Shibata et al. | 359/869 |
| 5,731,802 A | * | 3/1998 | Aras et al. | 345/148 |
| 5,771,321 A | * | 6/1998 | Stern | |
| 5,862,275 A | | 1/1999 | Takeuchi et al. | |
| 5,903,323 A | * | 5/1999 | Ernstoff et al. | 348/771 |
| 5,953,469 A | * | 9/1999 | Zhou | |
| 6,028,978 A | | 2/2000 | Takeuchi et al. | |
| 6,091,182 A | | 7/2000 | Takeuchi et al. | |

FOREIGN PATENT DOCUMENTS

| | | |
|---|---|---|
| EP | 0 667 647 A1 | 8/1995 |
| EP | 0 675 477 | 10/1995 |
| EP | 0 408 305 | 3/1996 |
| EP | 0 714 085 A1 | 5/1996 |
| EP | 0 851 260 A2 | 7/1998 |

* cited by examiner

*Primary Examiner*—Steven Saras
*Assistant Examiner*—Srilakshmi Kumar
(74) *Attorney, Agent, or Firm*—Burr & Brown

(57) ABSTRACT

Assuming that a display period for one image is one field, a light source turn on period and a light source turn off period are set for the one field. An overall bending displacement period for making bending displacement of all actuator elements is set within the light source turn off period. A gradational display period for performing substantial gradational display and a reset period for resetting the bending displacement of all of the actuator elements are set within the light source turn on period. Subfields of a number corresponding to the maximum gradation level are set within the gradational display period. Timing control is performed so that all row selection is completed within each of the subfields. Accordingly, the gradation level is advantageously extended when a relationship of Tr>>Tf is given between a light-emitting rising time Tr of the picture element and a quenching falling time Tf of the picture element.

29 Claims, 20 Drawing Sheets

| ROW | COLUMN 1 | GRADATION LEVEL |
|---|---|---|
| 1 | ⊗ | 2 |
| 2 | ⊗ | 1 |
| 3 | ⊗ | 3 |
| 4 | ○ | 4 |

DISPLAY-DRIVING DEVICE AND DISPLAY-DRIVING METHOD

BACKGROUND OF THE INVENTION

1. Field of the Invention

The present invention relates to a display device which consumes less electric power and which provides large screen brightness. In particular, the present invention relates to a display-driving device and a display-driving method for driving a display device for displaying a picture image corresponding to an image signal on an optical waveguide plate by controlling leakage light at a predetermined position of the optical waveguide plate by controlling the displacement action of an actuator element in a direction to make contact or separation with respect to the optical waveguide plate in accordance with an attribute of the image signal to be inputted.

2. Description of the Related Art

Those hitherto known as the display device include, for example, cathode ray tubes (CRT), liquid crystal display devices, and plasma displays.

Those known as the cathode ray tube include, for example, ordinary television receivers and monitor units for computers. Although the cathode ray tube has a bright screen, it consumes a large amount of electric power. Further, the cathode ray tube involves a problem that the depth of the entire display device is large as compared with the size of the screen. Further, for example, the cathode ray tube involves drawbacks in that the resolution is decreased in the circumferential areas of a display images, the image or the graphic is distorted, there is no memory function, and it is impossible to present display in a large scale.

The reason for the foregoing phenomenon is as follows. That is, in the case of the cathode ray tube, the electron beam emitted from the electron gun is greatly deflected. Therefore, the light emission point (beam spot) is expanded at portions at which the electron beam reaches the fluorescent screen of the Braun tube in an inclined manner, and thus the image is displayed in an inclined manner. For this reason, strain occurs on the display image. Moreover, there is a limit for the maintenance to keep a large space at the inside of a Braun tube to be in a vacuum.

On the other hand, the liquid crystal display device is advantageous in that the entire device can be miniaturized, and the display device consumes a small amount of electric power. However, the liquid crystal display device involves problems in that it is inferior in screen brightness, and the field angle of the screen is narrow. Further, since gradational expression is made in accordance with the voltage level, there is a drawback that the arrangement of the driving circuit becomes extremely complicated.

For example, when a digital data line is used, its driving circuit comprises a latch circuit for retaining component RGB data (each 8 bit) for a predetermined period, a voltage selector, a multiplexer for making change to provide voltage levels of the type corresponding to the number of gradations, and an output circuit for adding output data from the multiplexer to the digital data line. In this case, when the number of gradations becomes large, it is necessary for the multiplexer to perform the switching operation at an extremely large number of levels, in accordance with which the circuit arrangement becomes complicated.

When an analog data line is used, its driving circuit comprises a shift register for aligning, in the horizontal direction, component RGB data (each 8 bit) inputted successively, a latch circuit for holding parallel data from the shift register for a predetermined period, a level shifter for adjusting the voltage level, a D/A converter for converting output data from the level shifter into an analog signal, and an output circuit for adding the output signal from the D/A converter to the analog data line. In this case, an operational amplifier is used in the D/A converter. Thus, a predetermined voltage corresponding to the gradation is obtained. However, when the range of gradation becomes wide, it is necessary to use an operational amplifier which outputs a highly accurate voltage. Therefore, such a system involves a drawback that the structure becomes complicated, and the price also becomes high.

Since the plasma display has a small volume of its display section in the same manner as the liquid crystal display device. Therefore, the plasma display is advantageous in that it can be miniaturized, and it is easy to recognize the image because it has a flat display screen. Especially, the alternating current type plasma display additionally has an advantage that no refresh memory is required owing to the memory function of the cell.

By the way, in the case of the plasma display described above, in order to allow the cell to possess the memory function, it is necessary that the polarity of applied voltage is changed in an alternating manner so that the discharge is continued. For this reason, it is necessary for the driving circuit to comprise a first pulse generator for generating a sustain pulse in the X direction and a second pulse generator for generating a sustain pulse in the Y direction. For this reason, a problem arises in that the arrangement of the driving circuit is inevitably complicated.

SUMMARY OF THE INVENTION

The present invention has been made in consideration of such problems, an object of which is to provide a display-driving device and a display-driving method in which it is unnecessary to perform, for example, complicated voltage switch and voltage selection even when the range of display gradation is widened, it is possible to suppress the setting number of working voltages to the minimum, and it is possible to realize a simplified arrangement of a peripheral circuit system (including driving circuits).

Another object of the present invention is to provide a display-driving device and a display-driving method in which it is possible to exhibit the function as the display by maximally utilizing the memory function of a shape-retaining layer (piezoelectric/electrostrictive layer and anti-ferroelectric layer) of an actuator element for constructing a picture element (image pixel).

Still another object of the present invention is to provide a display-driving device and a display-driving method in which the selection period for a picture element is minimized so that the electric power consumption is effectively reduced.

Still another object of the present invention is to provide a display-driving device and a display-driving method in which the cross talk between picture elements during the unselection period is suppressed so that the stabilization of light emission and the stabilization of display brightness (gradation) are realized.

Still another object of the present invention is to provide a display-driving device and a display-driving method which is advantageous to extend the gradation level when the light-emitting rising time Tr of the picture element and the quenching falling time Tf of the picture element have a relationship of Tr>>Tf.

According to the present invention, there is provided a display-driving device for driving a display comprising an optical waveguide plate for introducing light thereinto, and a driving section provided opposingly to one plate surface of the optical waveguide plate and including a number of actuator elements arranged corresponding to a large number of picture elements, for displaying, on the optical waveguide plate, a picture image corresponding to an image signal by controlling leakage light at a predetermined portion of the optical waveguide plate by controlling displacement action of each of the actuator elements in a direction to make contact or separation with respect to the optical waveguide plate in accordance with an attribute of the image signal to be inputted; the display-driving device comprising a first driving circuit for selecting the actuator elements at least in one row unit, a second driving circuit for outputting displaying information to the selected row, and a signal control circuit for controlling the first and second driving circuits; wherein the first and second driving circuits are controlled to perform gradation control in accordance with a temporal modulation system by using the signal control circuit; a light source turn on period and a light source turn off period are set within one field provided that a display period for one image is defined as the one field; an overall bending displacement period for making bending displacement of all of the actuator elements is set within the light source turn off period; and a gradational display period for performing substantial gradational display is set within the light source turn on period.

According to the present invention, the signal control circuit performs control such that the first driving circuit selects the actuator elements (picture elements) at least in one row unit, and the second driving circuit outputs the display information to the respective picture elements included in the selected row. At this time, the first and second driving circuits are controlled by the aid of the signal control circuit so that the display effected by the respective picture elements makes gradational expression at least in accordance with the temporal modulation system.

During this process, all of the actuator elements are subjected to the bending displacement in the overall bending displacement period within the light source turn off period in the one field. For example, if the light is introduced into the optical waveguide plate in this state, all of the picture elements may cause light emission. However, all of the picture elements are in the light off state, because the light source is turned off.

And then, the control is made for the respective picture elements to perform the substantial gradational display during the gradational display period in the next light source turn on period. The gradational display resides in gradational control based on the temporal modulation system. Therefore, it is unnecessary to perform complicated voltage switch and voltage selection even when the range of display gradation of the picture elements is widened. Thus, the setting number of working voltages can be suppressed to the minimum.

In general, the time required to allow the actuator element to make bending displacement until light emission is sometimes extremely longer than the time required to reset the bending displacement of the actuator element until quenching. In such a case, it is necessary to set a delay time until light emission within the gradational display period. Such a procedure causes a problem that it is disadvantageous to extend the gradation level.

However, in the display-driving device according to the present invention, all of the actuator elements are subjected to the bending displacement during the light source turn off period before the gradational display period is started. Therefore, the light emission is performed for a period of time corresponding to the gradation level of each of the picture elements in the next gradational display period. After that, the bending displacement of the actuator element corresponding to the concerning picture element is reset to successfully turn off the picture element. Accordingly, it is unnecessary to set any preparatory period (delay time) for making bending displacement of the actuator element during the gradational display period. This results in maximum utilization of the limited gradational display period, making it possible to obtain an effect of advantage to extend the gradation level of the picture element.

In the present invention, it is desirable that the first and second driving circuits have the following features.

(1) The actuator element undergoes the capacitive load. Therefore, considering the fact that the capacitive load is subjected to the driving, it is desirable that the partial voltage ratio, which is applied to the capacitive load, is not less than 50%, for example, at the time of completion of voltage (ON voltage) application for allowing the actuator element to make the bending displacement.

(2) In order to obtain an displacement amount of the actuator element which makes it possible to express the ON state and the OFF state of the picture element, it is desirable that an voltage output of not less than 20 V can be provided.

(3) It is desirable to consider the fact that the direction of the output current is recognized to be bidirectional.

(4) It is desirable that the load concerning the two-electrode structure in the row direction and the column direction can be subjected to the driving.

It is desirable for the display-driving device constructed as described above that the actuator element of the display comprises a shape-retaining layer, an operating section having at least a pair of electrodes formed in contact with the shape-retaining layer, a vibrating section for supporting the operating section, and a fixed section for supporting the vibrating section in a vibrating manner; wherein the display comprises a displacement-transmitting section for transmitting the displacement action of the actuator element to the optical waveguide plate, the displacement action being generated by voltage application to the pair of electrodes. In the present invention, the term "actuator element having the shape-retaining layer" indicates an actuator element which has at least two or more displacement states at an identical voltage level.

Accordingly, all of the light, which is introduced, for example, from the end of the optical waveguide plate, is totally reflected at the inside of the optical waveguide plate without being transmitted through the front and back surfaces of the optical waveguide plate (OFF state), by regulating the magnitude of the refractive index of the optical waveguide plate. In this state, when the displacement-transmitting section contacts with the back surface of the optical waveguide plate at a distance of not more than the wavelength of the light, then the light, which has been totally reflected, is transmitted to the surface of the displacement-transmitting section contacting with the back surface of the optical waveguide plate. The light, which has once reached the surface of the displacement-transmitting section, is reflected by the surface of the displacement-transmitting section, and the light behaves as scattered light. A part of the scattered light is reflected again at the inside of the optical waveguide plate. However, almost all of the scattered light is not reflected by the optical waveguide plate, and the light is transmitted through the front surface of the optical waveguide plate (ON state).

As described above, it is possible to control the presence or absence of light emission (leakage light) at the front surface of the optical waveguide plate, depending on the presence or absence of the contact of the displacement-transmitting section disposed at the back of the optical waveguide plate. In this case, one unit for allowing the displacement-transmitting section to make the displacement action in the direction to give contact or separation with respect to the optical waveguide plate may be regarded as one picture element. Thus, a picture image (for example, characters and graphics) corresponding to an image signal can be displayed on the front surface of the optical waveguide plate in the same manner as the cathode ray tube and the liquid crystal display device, by arranging a large number of such picture elements in a matrix form, and controlling the displacement action of each of the picture elements in accordance with an attribute of the inputted image signal.

The actuator element having the shape-retaining layer has the following features.

(1) The threshold characteristic concerning the change from the OFF state to the ON state is steep as compared with the case in which no shape-retaining layer exists. Accordingly, it is possible to narrow the deflection width of the voltage, and it is possible to mitigate the load on the circuit.

(2) The difference between the ON state and the OFF state is distinct, resulting in improvement in contrast.

(3) The dispersion of threshold value is decreased, and an enough margin is provided for the voltage setting range.

It is desirable to use, as the actuator element, an actuator element which makes, for example, upward displacement (giving the separated state upon no voltage load and giving the contact state upon voltage application) because of easiness of control. Especially, it is desirable to use an actuator element having a structure including a pair of electrodes on its surface. It is preferable to use, for example, a piezoelectric/electrostrictive layer and an anti-ferroelectric layer as the shape-retaining layer.

It is also preferable for the display-driving device constructed as described above that the gradational display period comprises a plurality of subfields, a selection period and an unselection period are set for each of the subfields, and any of operations of maintenance of light emission/quenching is performed in accordance with a gradation level of the picture element upon selection of the picture element.

In this embodiment, the operation of maintenance of light emission is performed in each selection period ranging from the first subfield to the subfield of a number corresponding to the gradation level of the picture element, of the plurality of subfields, and the operation of quenching is performed in each selection period for the following subfields.

It is also preferable for the display-driving device constructed as described above that the first driving circuit is subjected to timing control by the signal control circuit so that all row selection is completed within each of the subfields by using the first driving circuit, and the second driving circuit is subjected to timing control by the signal control circuit so that a data signal, which is prepared by allotting a display time corresponding to each gradation level to an effective display period of each subfield, is outputted during the selection period of each subfield, for each of the picture elements concerning the selected row, by using the second driving circuit.

According to this embodiment, at first, the group of picture elements disposed in the first row are selected by the first driving circuit upon the start of one field. The data signal is supplied to the group of picture elements in the first row by the aid of the second driving circuit. The data signal supplied to each of the picture elements is a data signal (for example, ON signal and OFF signal) prepared by allotting the display time corresponding to the gradation level to each of the subfields. When one picture element is observed, the display time corresponding to the gradation level of the picture element is assigned to the time width allotted to each of the subfields. This procedure includes a case in which the display time is assigned to all of the subfields, and a case in which the display time is assigned to some of the subfields.

Specifically, for example, when one field is divided into four subfields (first to fourth subfields), the following assignment is available. That is, the time width of the continuous first to fourth subfields is 4, the time width of the continuous first to third subfields is 3, the time width of the continuous first and second subfields is 2, and the time width of the first subfield is 1.

Therefore, for example, the gradation level of the picture element is 4, all of the subfields are selected. When the gradation level is 2, the first and second subfields are selected.

Those adoptable as the output form of the data signal supplied to the picture element include, for example, a form in which the ON signal is outputted to the selected subfield, and the OFF signal is outputted to the unselected subfield.

It is desirable that each of the first and second driving circuits comprises only one driving circuit, i.e., the first and second driving circuits comprise only two driving circuits. The use of the only two driving circuits is sufficient, because the actuator element has the structure composed of the two electrodes (pair of electrodes), and it has the shape-retaining function.

It is also preferable that a voltage sufficient to maintain the bending displacement of the actuator element is applied to the actuator element corresponding to an objective picture element within the selection period during the operation of maintenance of light emission, and a voltage sufficient to reset the displacement of the actuator element is applied to the actuator element corresponding to the objective picture element within the selection period during the operation of quenching.

In another embodiment, it is also preferable that a direction for scanning the picture element in each of the subfields is different between the fields adjacent to one another. In this embodiment, it is possible to avoid occurrence of discrepancy corresponding to one gradation between the picture element in the first row and the picture element in the final row, making it possible to improve the image quality.

It is preferable for the display-driving device constructed as described above that at least a reset period for making display brightness to be substantially zero is provided between a certain gradational display period and the next gradational display period. Accordingly, the display brightness is once made zero during the reset period. Therefore, it is easy to respond to the display of an animation image.

It is desirable for the display-driving device constructed as described above that the first driving circuit is capable of setting at least three voltage levels, and the second driving circuit is capable of setting at least two voltage levels.

In another preferred embodiment, the selection of the row is performed by the first driving circuit by outputting a selection pulse signal during the selection period, and outputting an unselection signal during the unselection period; and the output of the data signal is performed by the second driving circuit by outputting an ON signal during the selection period of an allotted subfield of the respective subfields, and outputting an OFF signal during the selection periods of the other subfields.

In this embodiment, a voltage sufficient to maintain the bending displacement of the actuator element is applied to the actuator element corresponding to an objective picture element within the output period of the ON signal, and a voltage sufficient to reset the displacement of the actuator element is applied to the actuator element corresponding to the objective picture element within the output period of the OFF signal.

Accordingly, the sufficient voltage to maintain the bending displacement of the actuator element is applied to the picture element during the selection period for the subfield selected by assigning the time width of the gradation level for one picture element. Therefore, the bending displacement is maintained for the concerning actuator element owing to the voltage application. Thus, the occurrence of leakage light (light emission) from the optical waveguide plate as described above is maintained. The bending displacement state is stored until the voltage is applied in the opposite direction (until the OFF signal is supplied).

The unselection signal is outputted during the unselection period after the selection period. In this case, the unselection signal may be a signal fixed at a voltage smaller than the voltage used during the selection period, or the unselection signal may be a signal which fluctuates in an alternating manner. Accordingly, the state of the bending displacement in one direction is maintained for the actuator element during the unselection period.

As for the unselected subfield, the voltage sufficient to reset the bending displacement of the concerning actuator element is applied to the concerning picture element during the selection period. Accordingly, the concerning picture element is in the state of the lowest brightness (quenching).

It is also preferable that the first driving circuit outputs a selecting window pulse for applying the voltage sufficient to maintain the bending displacement of the actuator element to the actuator element of an objective picture element by means of combination with the ON signal during the selection period. Alternatively, it is also preferable that the first driving circuit outputs a signal for applying the voltage sufficient to reset the bending displacement of the actuator element to the actuator element of an objective picture element by means of combination with the OFF signal during the selection period.

It is desirable for the display-driving device constructed as described above that phase information is added at least to the OFF signal so that a difference in average voltage applied during the unselection period to the actuator element of each of the picture elements is decreased.

Ideally, during the unselection period, it is desirable to apply a fixed electric potential in a degree not to affect the bending displacement as described above, because it is necessary to maintain the bending displacement state of the actuator element as it is.

However, since all of the row selection is completed in each subfield, the data signal (ON signal and OFF signal) for another row successively appears during the unselection period of each subfield. That is, when observation is made for one picture element, the voltage waveform of the concerning picture element during the unselection period is determined by the pattern of the data signal (appearance pattern of the ON signal and the OFF signal) for the row other than the row to which the concerning picture element belongs, in the column to which the concerning picture element belongs.

For example, when the ON signal is outputted for all of the rows other the row including the concerning picture element, the average voltage of the concerning picture element during the unselection period is fixed at a voltage level (conveniently referred to as "high voltage level") obtained by subtracting the reference level from the voltage level of the ON signal. When the OFF signal is outputted for all of the rows other the row including the concerning picture element, the average voltage is fixed at a voltage level (conveniently referred to as "low voltage level") obtained by subtracting the reference level from the voltage level of the OFF signal. When the ON signal and the OFF signal are alternately outputted in the unit of row for all of the rows other the row including the concerning picture element, the average voltage is at an intermediate voltage between the high voltage level and the low voltage level.

As a result, the bending displacement of the actuator element during the unselection period is delicately changed depending on the voltage change (voltage change depending on the pattern of the ON signal and the OFF signal). Especially, when the ON signal or the OFF signal is collectively outputted for a large number of rows, the difference in average voltage is large. Therefore, there is a possibility that the display state (brightness and gradation) may become unstable during the unselection period for the concerning picture element.

When the ON signal and the OFF signal appear in an alternating manner, then the waveform of the average voltage in this case is not fixed at the intermediate voltage as described above, and it fluctuates while giving a certain offset, because the pulse width of the ON signal and the OFF signal is approximately the same as the selection period.

Thus, in the present invention, in order to solve the problem described above, the phase information is added to the selection pulse signal and the ON signal and/or the OFF signal respectively.

Accordingly, both of the ON signal and the OFF signal constitute a pulse signal including the high level and the low level which exist in a mixed manner during the period corresponding to the selection period.

Therefore, as described above, when consideration is made for one picture element, the pulse signal having a narrow pulse width, in which the amplitude is (high voltage level—low voltage level), continuously appears during the unselection period for the concerning picture element in all cases including, for example, a case in which the ON signal is outputted for all of the rows, a case in which the OFF signal is outputted for all of the rows, and a case in which the ON signal and the OFF signal are alternately outputted in the unit of row. As a result, the average voltage during the unselection period does not depend on the pattern of the ON signal and the OFF signal, and it has an approximately constant value. Therefore, the display state (brightness and gradation) during the unselection period is stabilized.

According to another aspect of the present invention, there is provided a display-driving method for driving a display comprising an optical waveguide plate for introducing light thereinto, and a driving section provided oppositely to one plate surface of the optical waveguide plate and including a number of actuator elements arranged corresponding to a large number of picture elements, for displaying, on the optical waveguide plate, a picture image corresponding to an image signal by controlling leakage light at a predetermined portion of the optical waveguide plate by controlling displacement action of each of the actuator elements in a direction to make contact or separation with respect to the optical waveguide plate in accordance with an attribute of the image signal to be inputted; the display-driving method comprising the steps of selecting the actuator elements at least in one row unit; outputting displaying information to the selected row; and making gradation control for each of the picture elements in accordance with a temporal modulation system; wherein a light source turn on period and a light source turn off period are set within one field provided that a display period for one image is defined as the one field; an overall bending displacement period for making bending displacement of all of the actuator elements is set within the light source turn off period; and a gradational display period for performing substantial gradational display is set within the light source turn on period.

Accordingly, it is unnecessary to perform, for example, complicated voltage switch and voltage selection even when the range of display gradation is widened, it is possible to suppress the setting number of working voltages to the minimum, and it is possible to realize a simplified arrangement of a peripheral circuit system (including driving circuits).

Even when the time required to allow the actuator element to make bending displacement until light emission is extremely longer than the time required to reset the bending displacement of the actuator element until quenching, it is possible to maximally utilize the limited gradational display period, providing an effect of advantage to extend the gradation level of the picture element.

In the method described above, the gradational display period comprises a plurality of subfields, a selection period and an unselection period are set for each of the subfields, and any of operations of maintenance of light emission/quenching is performed in accordance with a gradation level of the picture element upon selection of the picture element.

In this embodiment, timing control is performed by the signal control circuit so that all row selection is completed within each of the subfields, and a data signal, which is prepared by allotting a display time corresponding to each gradation level to an effective display period of each subfield, is outputted during the selection period of each subfield, for each of the picture elements concerning the selected row.

It is preferable that a voltage sufficient to maintain the bending displacement of the actuator element is applied to the actuator element corresponding to an objective picture element within the selection period during the operation of maintenance of light emission, and a voltage sufficient to reset the displacement of the actuator element is applied to the actuator element corresponding to the objective picture element within the selection period during the operation of quenching.

Especially, in order to avoid occurrence of discrepancy corresponding to one gradation between the picture element in the first row and the picture element in the final row, it is preferable that a direction for scanning the picture element in each of the subfields is different between the fields adjacent to one another.

It is preferable that at least a reset period for making display brightness to be substantially zero is provided between a certain gradational display period and the next gradational display period. By doing so, the display brightness is once made zero during the reset period. Therefore, it is easy to respond to the display of an animation image.

It is desirable for the method described above that at least three voltage levels are capable of being set upon the selection of the row, and at least two voltage levels are capable of being set upon the output of the displaying information.

In another preferred embodiment, upon the selection of the row, a selection pulse signal is outputted during the selection period, and an unselection signal is outputted during the unselection period; and upon the output of the displaying information, an ON signal is outputted during the selection period of an allotted subfield of the respective subfields, and an OFF signal is outputted during the selection periods of the other subfields.

It is preferable for the method described above that a voltage sufficient to maintain the bending displacement of the actuator element is applied to the actuator element corresponding to an objective picture element within the output period of the ON signal, and a voltage sufficient to reset the displacement of the actuator element is applied to the actuator element corresponding to the objective picture element within the output period of the OFF signal.

It is also preferable that a selecting window pulse for applying the voltage sufficient to maintain the bending displacement of the actuator element is outputted to the actuator element of an objective picture element by means of combination with the ON signal during the selection period. Alternatively, it is also preferable that a signal for applying the voltage sufficient to reset the bending displacement of the actuator element is outputted to the actuator element of an objective picture element by means of combination with the OFF signal during the selection period.

It is preferable that phase information is added at least to the OFF signal so that a difference in average voltage applied during the unselection period to the actuator element of each of the picture elements is decreased. Specifically, it is preferable that the phase information is added to the selection pulse signal and the ON signal and/or the OFF signal respectively.

As explained above, according to the display-driving device and the display-driving method concerning the present invention, it is unnecessary to perform, for example, complicated voltage switch and voltage selection even when the range of display gradation is widened, it is possible to suppress the setting number of working voltages to the minimum, and it is possible to realize a simplified arrangement of a peripheral circuit system (including driving circuits).

Further, it is possible to exhibit the function as the display by maximally utilizing the memory function of the shape-retaining layer (piezoelectric/electrostrictive layer and antiferroelectric layer) of the actuator element for constructing the picture element (image pixel).

Furthermore, the selection period for the picture element is minimized so that the electric power consumption is effectively reduced, and the cross talk between the picture elements during the unselection period is suppressed so that the stabilization of light emission and the stabilization of display brightness (gradation) may be realized.

The present invention is advantageous to extend the gradation level when the light-emitting rising time Tr of the picture element and the quenching falling time Tf of the picture element have a relationship of Tr>>Tf.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Illustrative embodiments of the display-driving device and the display-driving method according to the present invention (hereinafter simply referred to as "driving device according to the embodiment") will be explained below with reference to FIGS. 1 to 21. Prior thereto, explanation will be made with reference to FIGS. 1 to 9 for the arrangement of the display to which the driving device according to the embodiment of the present invention is applied.

General Structure of Display

Figure 1:
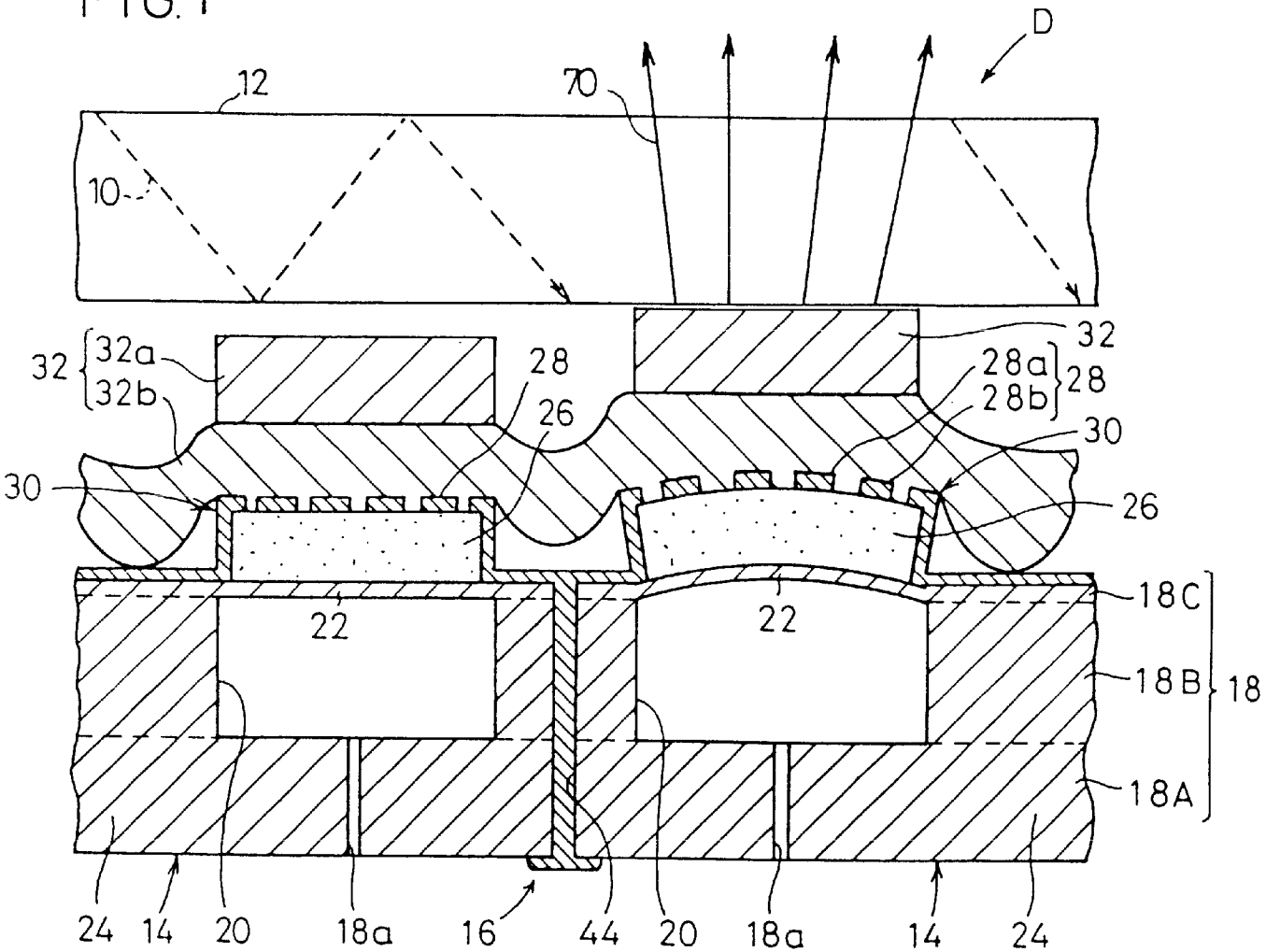
FIG. 1 shows a cross-sectional arrangement illustrating a display to which a driving device according to an embodiment of the present invention is applied.

As shown in FIG. 1, the display D comprises an optical waveguide plate 12 for introducing light 10 thereinto, and a driving section 16 provided opposingly to the back surface of the optical waveguide plate 12 and including a large number of actuator elements 14 which are arranged corresponding to picture elements (image pixels).

The display section 16 includes a substrate 18 composed of, for example, a ceramic. The actuator elements 14 are arranged at positions corresponding to the respective picture elements on the substrate 18. The substrate 18 has its first principal surface which is arranged to oppose to the back surface of the optical waveguide plate 12. The first principal surface is a continuous surface (flushed surface). Hollow spaces 20 for forming respective vibrating sections as described later on are provided at positions corresponding to the respective picture elements at the inside of the substrate 18. The respective hollow spaces 20 communicate with the outside via through-holes 18*a* each having a small diameter and provided at a second principal surface of the substrate 18.

The portion of the substrate 18, at which the hollow space 20 is formed, is thin-walled. The other portion of the substrate 18 is thick-walled. The thin-walled portion has a structure which tends to undergo vibration in response to external stress, and it functions as a vibrating section 22. The portion other than the hollow space 20 is thick-walled, and it functions as a fixed section 24 for supporting the vibrating section 22.

That is, the substrate 18 has a stacked structure comprising a substrate layer 18A as a lowermost layer, a spacer layer 18B as an intermediate layer, and a thin plate layer 18C as an uppermost layer. The substrate 18 can be recognized as an integrated structure including the hollow spaces 20 formed at the positions in the spacer layer 18B corresponding to the picture elements. The substrate layer 18A functions as a substrate for reinforcement, as well as it functions as a substrate for wiring. The substrate 18 may be sintered in an integrated manner, or it may be additionally attached.

As shown in FIG. 1, each of the actuator elements 14 comprises the vibrating section 22 and the fixed section 24 described above, as well as a main actuator element 30 including a shape-retaining layer 26 composed of, for example, a piezoelectric/electrostrictive layer or an anti-ferroelectric layer directly formed on the vibrating section 22 and a pair of electrodes 28 (a row electrode 28*a* and a column electrode 28*b*) formed on an upper surface of the shape-retaining layer 26, and a displacement-transmitting section 32 connected onto the main actuator element 30 as shown in FIG. 1, for increasing the contact area with respect to the optical waveguide plate 12 to obtain an area corresponding to the picture element.

That is, the display D has the structure in which the main actuator elements 30 comprising the shape-retaining layers 26 and the pairs of electrodes 28 are formed on the substrate 18. The pair of electrodes 28 may have a structure in which they are formed on upper and lower sides of the shape-retaining layer 26, or they are formed on only one side of the shape-retaining layer 26. However, in order to advantageously join the substrate 18 and the shape-retaining layer 26, it is preferable that the pair of electrodes 28 are formed only on the upper side (the side opposite to the substrate 18) of the shape-retaining layer 26 so that the substrate 18 directly contacts with the shape-retaining layer 26 without any difference in height, as in the display D.

Explanation of Shapes of Respective Constitutive Members

Figure 2:
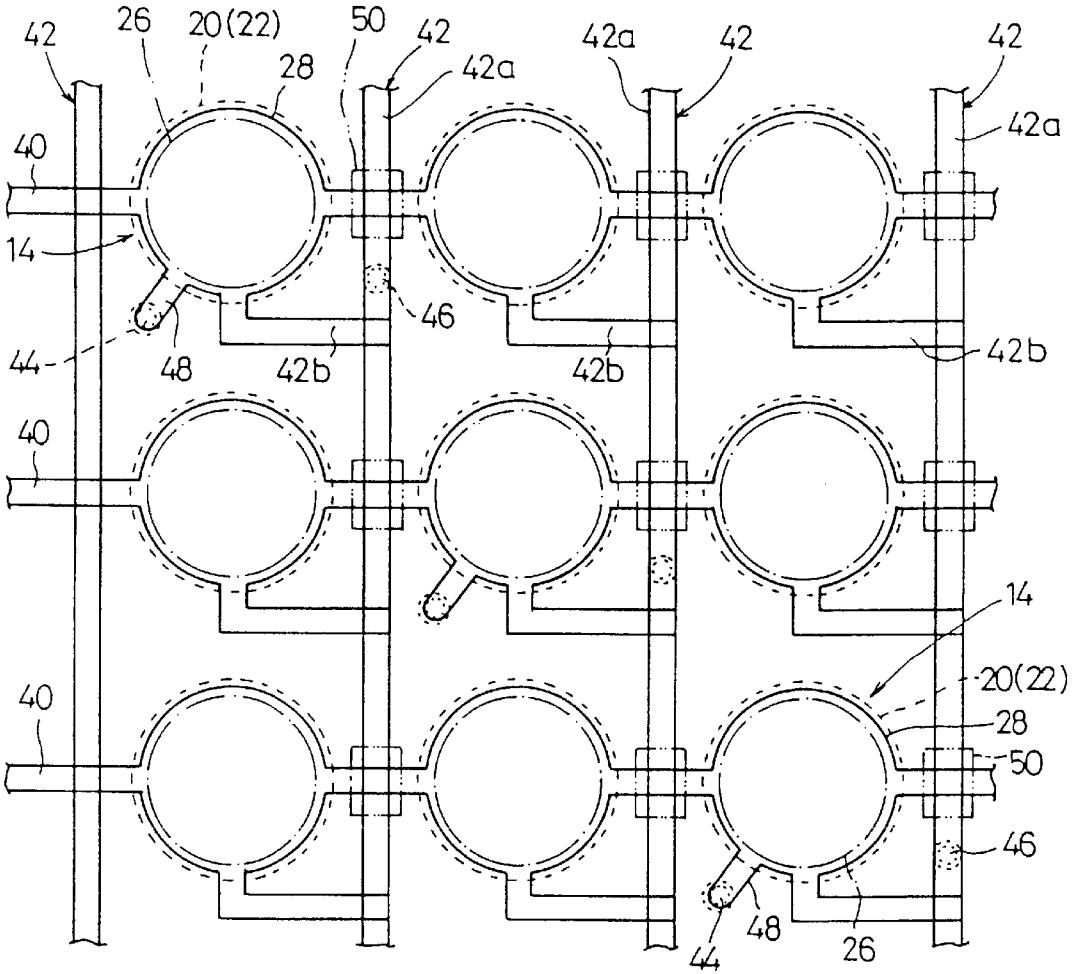
FIG. 2 shows a magnified plan view illustrating an arrangement of actuator elements (picture elements or image pixels) included in the display.

The shapes of the respective members will now be explained below with reference to FIGS. 2 to 10. At first, as shown in FIG. 2, the hollow space 20, which is formed in the substrate 18, has a circular circumferential superficial configuration, i.e., the vibrating section 22 has a circular planar configuration (see broken lines). The shape-retaining layer 26 has a circular planar configuration (see chain lines). The pair of electrodes 28 form an outer circumferential configuration which is circular as well (see solid lines). In this embodiment, the vibrating section 22 is designed to have the largest size. The outer circumferential configuration of the pair of electrodes 28 is designed to have the second largest size. The planar configuration of the shape-retaining layer 26 is designed to have the smallest size. Alternatively, it is allowable to make design so that the outer circumferential configuration of the pair of electrodes 28 is largest.

Figure 3:
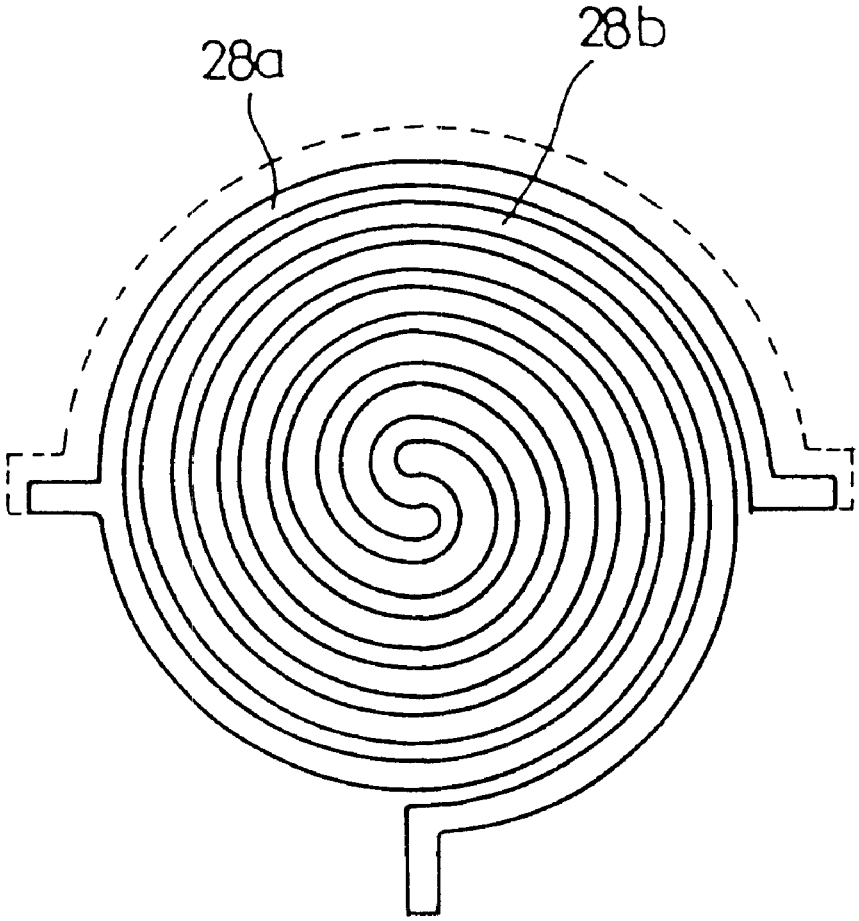
FIG. 3 shows a plan view illustrating a planar configuration (spiral configuration) of a pair of electrodes included in the display.

The pair of electrodes 28 (row electrodes 28*a* and column electrodes 28*b*) formed on the shape-retaining layer 26 have, for example, a spiral planar configuration as shown in FIG. 3, in which the pair of electrodes 28*a*, 28*b* are parallel to one another and separated from each other to form a spiral structure composed of several turns. The number of turns of the spiral is actually not less than 5 turns. However, FIG. 3 illustratively shows 3 turns in order to avoid complicated illustration.

As shown in FIG. 2, the wiring arrangement communicating with the respective electrodes 28*a*, 28*b* includes vertical selection lines 40 having a number corresponding to a number of rows of a large number of the picture elements, and signal lines 42 having a number corresponding to a number of columns of the large number of the picture elements. Each of the vertical selection lines 40 is electrically connected to the row electrode 28*a* of each of the picture elements (actuator elements 14, see FIG. 1). Each of the signal lines 42 is electrically connected to the column electrode 28*b* of each of the picture elements 14. The respective vertical selection lines 40, which are included in one row, are wired in series such that the wiring is led from the row electrode 28*a* provided for the picture element in the previous column, and then the wiring is connected to the row electrode 28*a* provided for the picture element in the present column. The signal line 42 comprises a main line 42*a* extending in the direction of the column, and branch lines 42*b* branched from the main line 42*a* and connected to the column electrode 28*b* of each of the picture elements 14.

The voltage signal is supplied to the respective vertical selection lines 40 from an unillustrated wiring board (stuck to the second principal surface of the substrate 18) via through-holes 44. The voltage signal is also supplied to the respective signal lines 42 from the unillustrated wiring board via through-holes 46.

Various arrangement patterns may be assumed for the through-holes 44, 46. However, in the illustrative arrangement shown in FIG. 2, the through-holes 44 for the vertical selection lines 40 are formed as follows provided that the number of rows is M, and the number of columns is N. In the case of N=M or N>M, the through-hole 44 is formed in the vicinity of a picture element in the nth row and nth column (n=1, 2 . . . ) and at a position deviated toward the signal line (main line) in the (n−1)th column. In the case of N<M, the through-hole 44 is formed in the vicinity of a picture element in the ($\alpha$N+n)th row and nth column ($\alpha$=0, 1 . . . (quotient of M/N−1)) and at a position deviated toward the signal line (main line) in the (n−1)th column.

On the other hand, the through-holes 46 for the signal lines 42 are formed as follows. In the case of N=M or N<M, the through-hole 46 is formed on the main line 42*a* of each of the signal lines 42 and at a position adjacent to a picture element in the nth row and nth column (n=1, 2 . . . ). In the case of N>M, the through-hole 46 is formed on the main line 42*a* of each of the signal lines 42 and at a position adjacent to a picture element in the nth row and ($\beta$M+n)th column ($\beta$=0, 1 . . . (quotient of N/M−1)). The through-hole 44 for the vertical selection line 40 is not formed on the vertical selection line 40, unlike the through-hole 46 for the signal line 42. Accordingly, a relay conductor 48 is formed between the through-hole 44 and the row electrode 28*a*, for making electric continuity therebetween.

Insulative films 50 (shown by two-dot chain lines), each of which is composed of, for example, a silicon oxide film, a glass film, or a resin film, are allowed to intervene at portions of intersection between the respective vertical selection lines 40 and the respective signal lines 42, in order to ensure insulation between the mutual wiring arrangements 40, 42.

Figure 4:
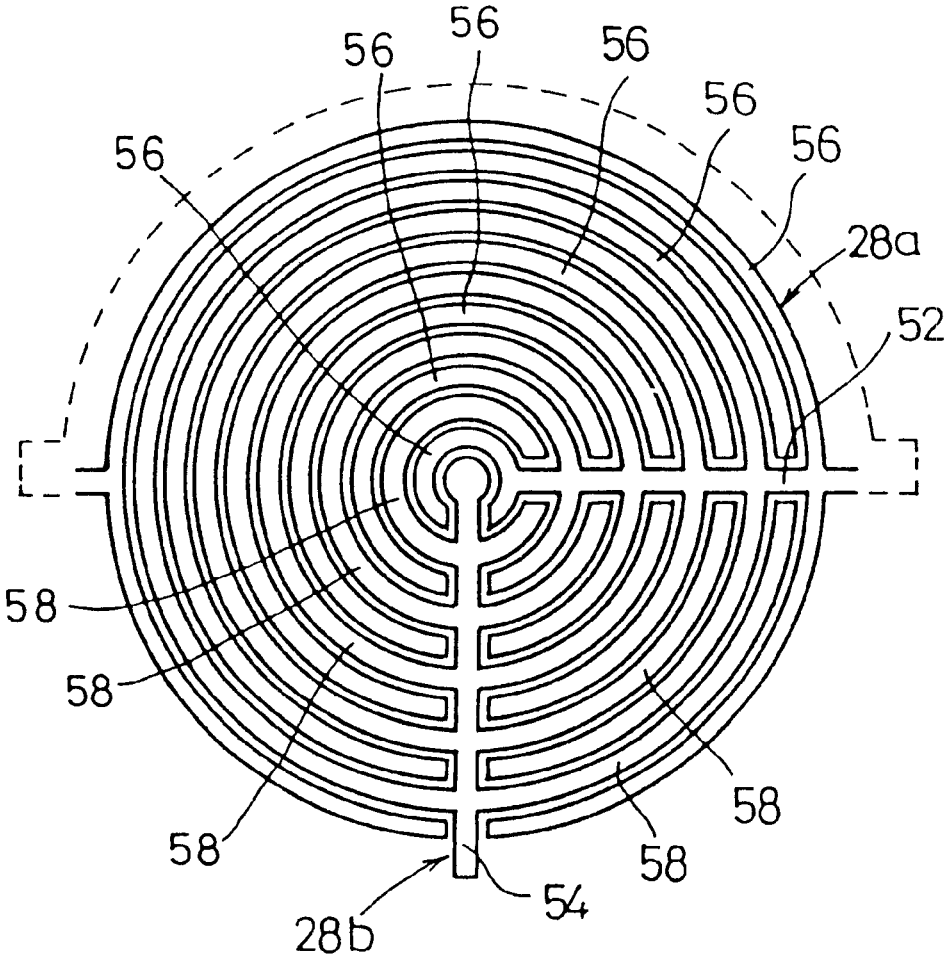
FIG. 4 shows a plan view illustrating a planar configuration (branched configuration) of a pair of electrodes included in the display.

The planar configuration of the pair of electrodes 28 is not limited to the spiral configuration as shown in FIG. 3. The planar configuration may be a configuration as shown in FIG. 4. Specifically, each of the pair of electrodes 28*a*, 28*b* has a configuration composed of a trunk 52, 54 which extends toward the center of the shape-retaining layer 26, and a lot of branches 56, 58 branched from the trunk 52, 54. In this configuration, the pair of electrodes 28*a*, 28*b* are separated from each other and arranged complementarily (hereinafter referred to as "branched configuration" for convenience).

Figure 5:
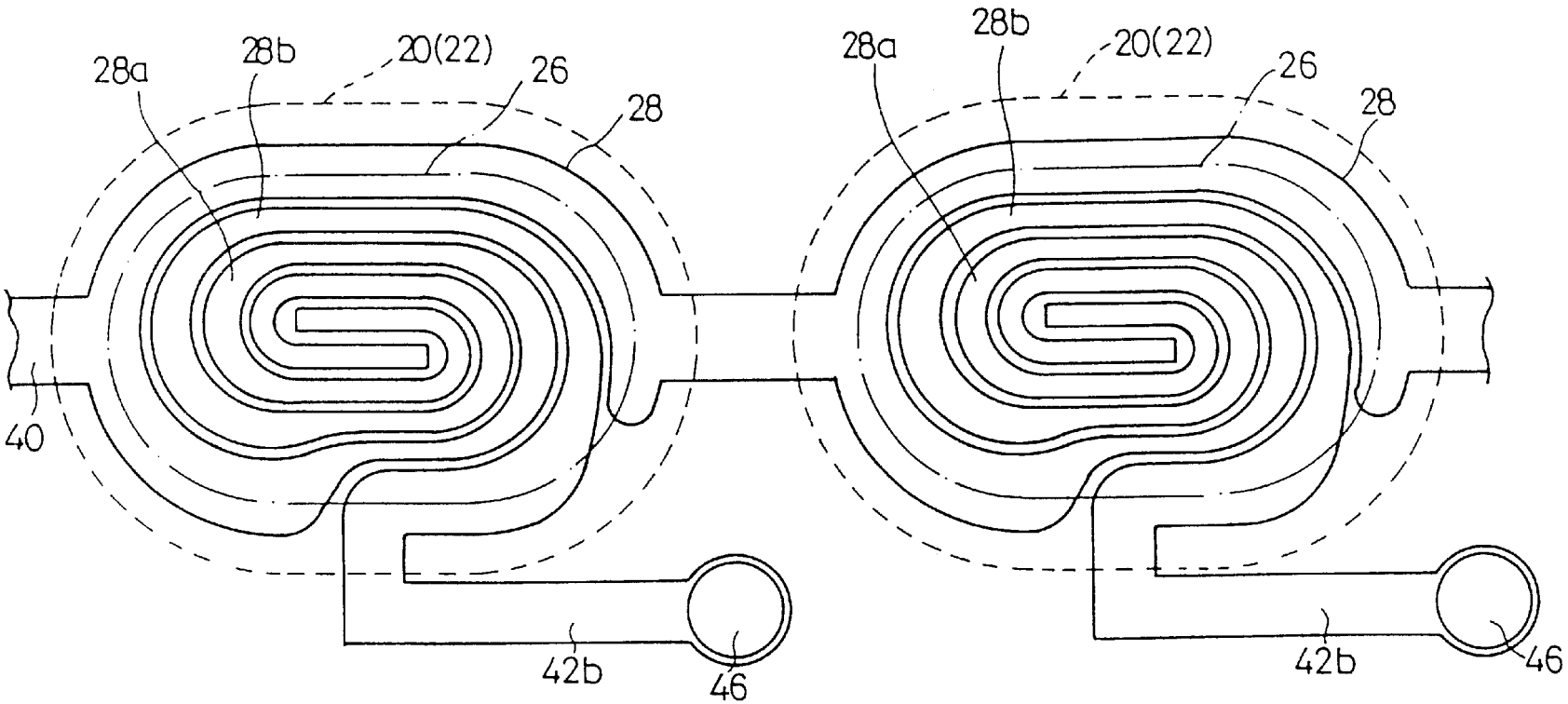
FIG. 5 shows a plan view illustrating a planar configuration (oblong configuration, spiral configuration) of a vibrating section, a shape-retaining layer, and a pair of electrodes included in the display.
Figure 6:
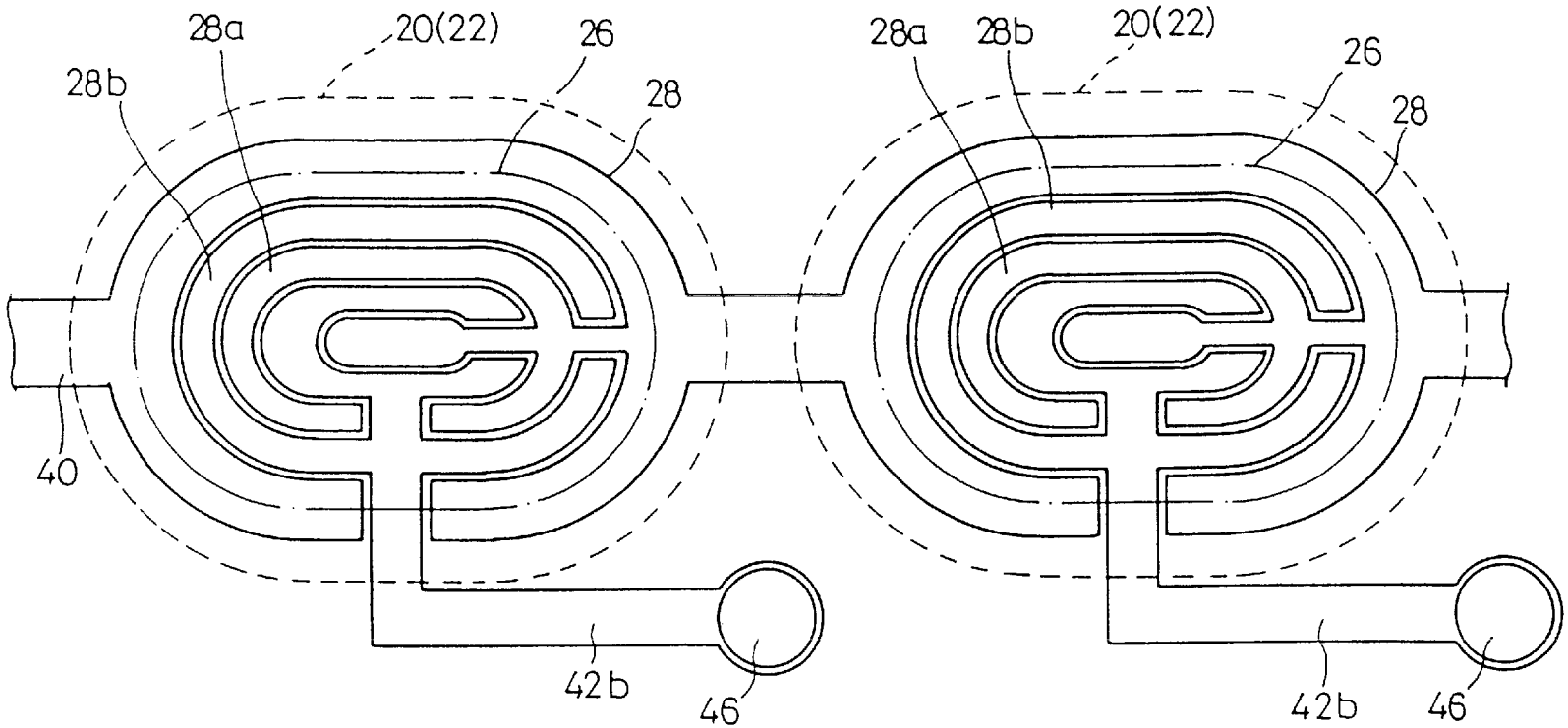
FIG. 6 shows a plan view illustrating a planar configuration (oblong configuration, branched configuration) of a vibrating section, a shape-retaining layer, and a pair of electrodes included in the display.
Figure 7:
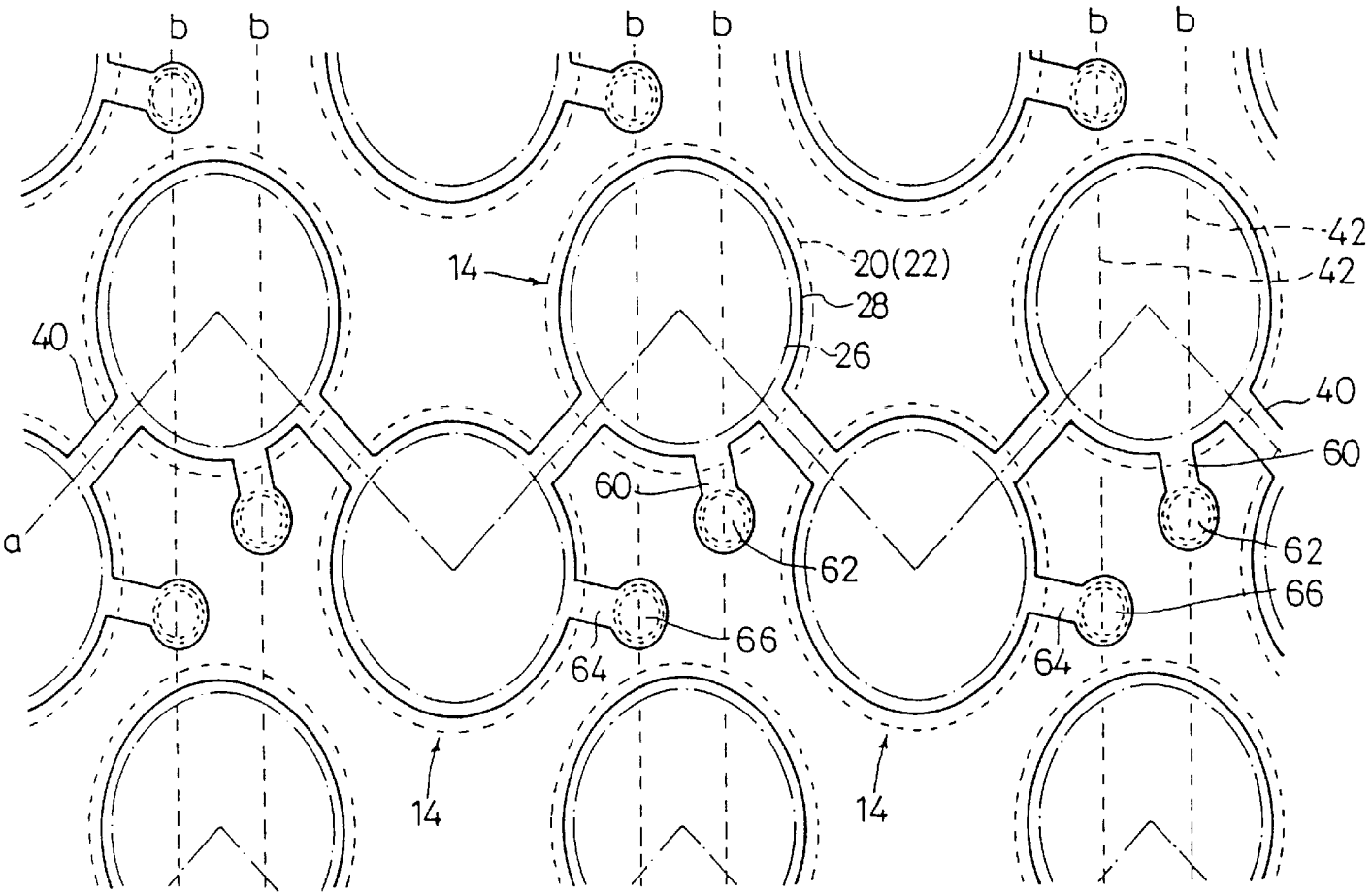
FIG. 7 shows a magnified plan view illustrating another exemplary arrangement of actuator elements (picture elements) included in the display.

The display D constructed as described above has been explained as one having the circular planar configuration of the vibrating section 22, the circular planar configuration of the shape-retaining layer 26, and the circular outer circumferential configuration formed by the pair of electrodes 28. Alternatively, it is also preferable to use oblong configurations (track configurations) as shown in FIGS. 5 and 6, and an elliptic configuration as shown in FIG. 7.

Figure 8:
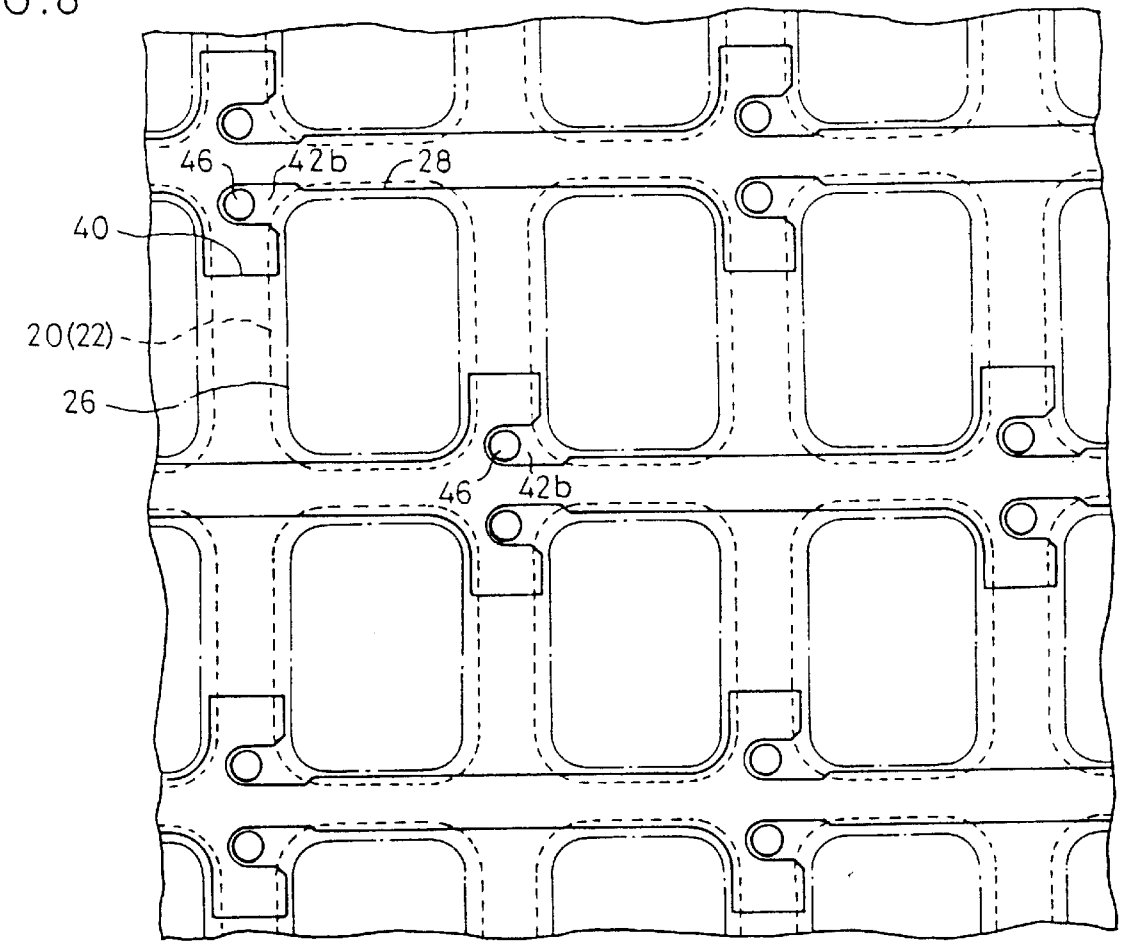
FIG. 8 shows a magnified plan view illustrating another arrangement of actuator elements (picture elements) included in the display.

Further alternatively, both of the planar configuration of the vibrating section 22 and the planar configuration of the shape-retaining layer 26 may be rectangular configurations with smoothed corners as shown in FIG. 8. Further alternatively, both of the planar configuration of the vibrating section 22 and the planar configuration of the shape-retaining layer 26 may be polygonal configurations (for example, octagonal configurations) with respective apex angle portions having rounded shapes as shown in FIG. 9.

The configuration of the vibrating section 22, the planar configuration of the shape-retaining layer 26, and the outer circumferential configuration formed by the pair of electrodes 28 may be combinations of circular and elliptic configurations, or combinations of rectangular and elliptic configurations, without any special limitation. Although not shown, those preferably adopted as the planar configuration of the shape-retaining layer 26 include a ring-shaped configuration. In this case, those usable as the outer circumferential configuration include various ones such as circular, elliptic, and rectangular configurations. The ring-shaped planar configuration of the shape-retaining layer 26 makes it unnecessary to form any electrode on the hollow portion. Therefore, it is possible to decrease the electrostatic capacity without decreasing the displacement amount.

Figure 9:
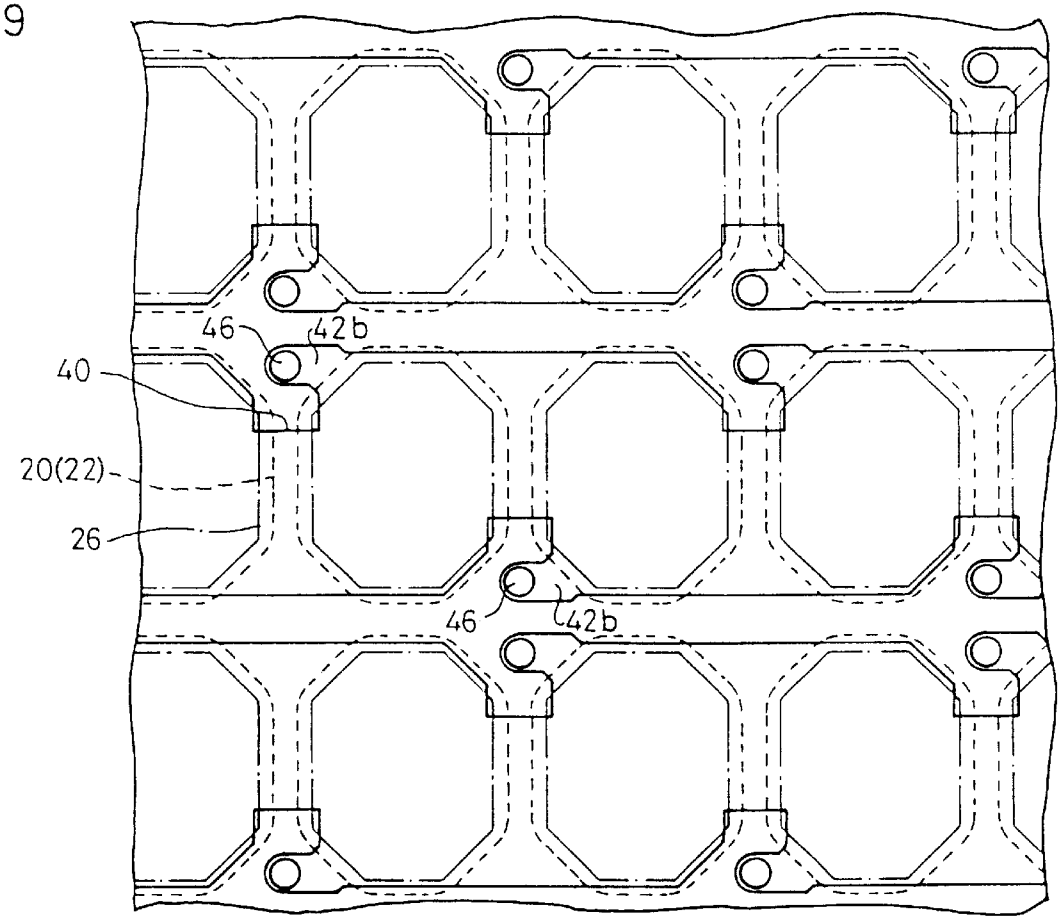
FIG. 9 shows a magnified plan view illustrating another arrangement of actuator elements (picture elements) included in the display.

In the illustrative arrangements shown in FIGS. 2, 8, and 9, the respective actuator elements 14 (picture elements) are illustratively arranged in the matrix form on the substrate 18. Alternatively, as shown in FIG. 7, the picture elements (actuator elements) 14 may be arranged in a zigzag form with respect to the respective rows. In the case of the arrangement pattern shown in FIG. 7, the actuator elements (picture elements) 14 are arranged in the zigzag form in relation to the respective rows. Accordingly, the line (indicated by a chain line "a") connecting through the vertical selection lines 40 respectively has a zigzag form in relation to each of the rows. The signal lines 42 have a wiring pattern as shown by broken lines "b" wired on the unillustrated wiring board, in which the picture elements 14 arranged in the zigzag form are divided, for example, into a group of picture elements (actuator elements) 14 located vertically upwardly and a group of picture elements (actuator elements) 14 located vertically downwardly, and two signal lines 42 are wired mutually adjacently at positions corresponding to the former and latter groups of picture elements. In FIG. 7, the picture elements arranged in the zigzag form are wired as follows. That is, for example, the column electrode 28*b* of the picture element (actuator element) 14 located vertically upwardly is electrically connected to the right signal line 42 of the mutually adjacent two signal lines 42, 42, via a relay conductor 60 and a through-hole 62. The column electrode 28*b* of the picture element (actuator element) 14 located vertically downwardly is electrically connected to the left signal line 42 of the mutually adjacent two signal lines 42, 42, via a relay conductor 64 and a through-hole 66.

Explanation of Shape-Retaining Layer

By the way, when the piezoelectric/electrostrictive layer is used as the shape-retaining layer 26, those usable as the piezoelectric/electrostrictive layer include ceramics containing, for example, lead zirconate, lead magnesium niobate, lead nickel niobate, lead zinc niobate, lead manganese niobate, lead magnesium tantalate, lead nickel tantalate, lead antimony stannate, lead titanate, barium titanate, lead magnesium tungstate, and lead cobalt niobate, as well as any combination of them. It is needless to say that the major component contains the compound as described above in an amount of not less than 50% by weight. Among the ceramics described above, the ceramic containing lead zirconate is most frequently used as the constitutive material of the piezoelectric/electrostrictive layer according to the embodiment of the present invention.

When the piezoelectric/electrostrictive layer is composed of a ceramic, it is also preferable to use ceramics obtained by appropriately adding, to the ceramics described above, oxide of, for example, lanthanum, calcium, strontium, molybdenum, tungsten, barium, niobium, zinc, nickel, and manganese, or any combination thereof or another type of compound thereof. For example, it is preferable to use a ceramic containing a major component composed of lead magnesium niobate, lead zirconate, and lead titanate and further containing lanthanum and strontium.

The piezoelectric/electrostrictive layer may be either dense or porous. When the piezoelectric/electrostrictive layer is porous, its porosity is preferably not more than 40%.

When the anti-ferroelectric layer is used as the shape-retaining layer 26, it is desirable to use, as the anti-ferroelectric layer, a compound containing a major component composed of lead zirconate, a compound containing a major component composed of lead zirconate and lead stannate, a compound obtained by adding lanthanum to lead zirconate, and a compound obtained by adding lead zirconate and lead niobate to a component composed of lead zirconate and lead stannate.

Especially, when an anti-ferroelectric film, which contains a component comprising lead zirconate and lead stannate as represented by the following composition, is applied as a film-type element such as the anti-ferroelectric film-type element, it is possible to perform driving at a relatively low voltage. Therefore, application of such an anti-ferroelectric film is especially preferred.

$$Pb_{0.99}Nb_{0.02}[(Zr_xSn_{1-x})_{1-y}Ti_y]_{0.98}O_3$$

wherein, $0.5<x<0.6$, $0.05<y<0.063$, $0.01<Nb<0.03$.

The anti-ferroelectric layer may be porous. When the anti-ferroelectric layer is porous, it is desirable that the porosity is not more than 30%.

Explanation of Operation of Display

Next, the operation of the display D constructed as described above will be briefly described with reference to FIG. 1. At first, the light 10 is introduced, for example, from the end portion of the optical waveguide plate 12. In this embodiment, all of the light 10 is totally reflected at the inside of the optical waveguide plate 12 without being transmitted through the front and back surfaces thereof by controlling the magnitude of the refractive index of the optical waveguide plate 12. In this state, when a certain actuator element 14 is in the selected state, and the displacement-transmitting section 32 corresponding to the actuator element 14 contacts, at a distance of not more than the wavelength of light 10, with the back surface of the optical waveguide plate 12, then the light 10, which has been totally reflected until that time, is transmitted to the surface of the displacement-transmitting section 32 contacting with the back surface of the optical waveguide plate 12.

The light 10, which has once arrived at the surface of the displacement-transmitting section 32, is reflected by the surface of the displacement-transmitting section 32, and it behaves as scattered light 70. A part of the scattered light 70 is reflected again in the optical waveguide plate 12. However, almost all of the scattered light 70 is not reflected by the optical waveguide plate 12, and it is transmitted through the front surface of the optical waveguide plate 12.

That is, the presence or absence of light emission (leakage light) at the front surface of the optical waveguide plate 12 can be controlled depending on the presence or absence of the contact of the displacement-transmitting section 32 disposed at the back of the optical waveguide plate 12. Especially, in the display device according to the embodiment of the present invention, one unit for making the displacement action of the displacement-transmitting section 32 in the direction to make contact or separation with respect to the optical waveguide plate 12 may be recognized as one picture element. A large number of the picture elements are arranged in a matrix configuration or in a zigzag configuration concerning the respective rows. Therefore, it is possible to display a picture image (characters and graphics) corresponding to the image signal on the front surface of the optical waveguide plate in the same manner as the cathode ray tube, the liquid crystal display device, and the plasma display, by controlling the displacement action in each of the picture elements in accordance with the attribute of the inputted image signal.

Principle of Operation of Actuator Element

Figure 10:
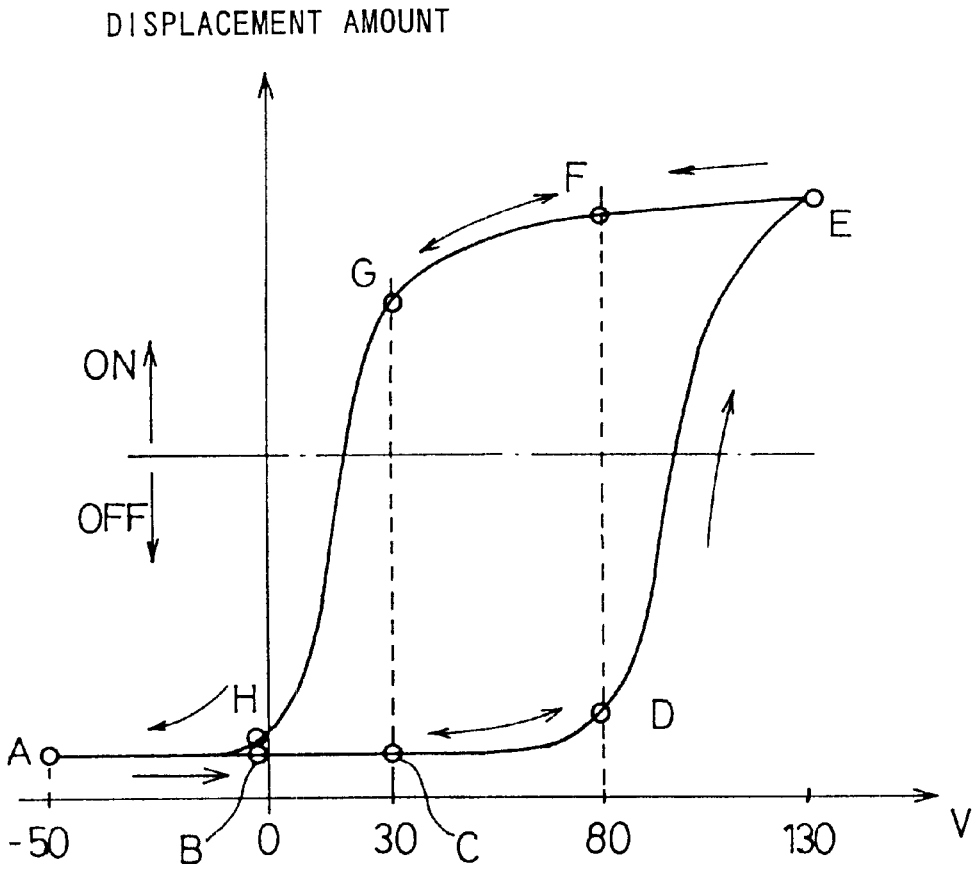
FIG. 10 shows a bending displacement characteristic of the actuator element (picture element) included in the display.

Next, the principle of operation effected in the respective actuator elements 14 when the piezoelectric layer is used as the shape-retaining layer 26 will be explained on the basis of the bending displacement characteristic shown in FIG. 10. The bending displacement characteristic shown in FIG. 10 is obtained by applying a voltage between the pair of electrodes 28*a*, 28*b* of the main actuator element 30 to perform a polarization treatment for the shape-retaining layer 26, and then observing the bending displacement of the actuator element 14 while continuously changing the voltage applied to the actuator element 14. In this embodiment, as shown in FIG. 1, the direction of bending displacement is positive when the actuator element 14 makes bending displacement in a first direction (direction to make approach to the optical waveguide plate 12).

The measurement of the bending displacement characteristic will be specifically explained with reference to an example. At first, when a voltage is applied between the pair of electrodes 28*a*, 28*b* to perform the polarization treatment for the shape-retaining layer 26, an electric field in the positive direction is generated in the superficial direction around the first principal surface of the shape-retaining layer 26.

The intensity of the electric field generated in the shape-retaining layer 26 is largest at the first principal surface, and it is gradually decreased in the depth direction. Therefore, it is difficult to advance the polarization at deep portions. However, the polarization can be allowed to proceed to portions located in the depth direction by applying a sufficient electric field and an appropriate amount of heat for a sufficient period of time.

A voltage, which exceeds the range of use of the voltage (for example, −50 V to 130 V) usable to operate the actuator element 14 of the display D, is applied, for example, for 7 hours at an appropriate temperature. Thus, the polarization treatment is achieved in the same direction as that of the generated electric field.

After that, the voltage application between the pair of electrodes 28*a*, 28*b* is stopped to give a no-voltage-loaded state. Simultaneously with the start of measurement, a sine wave having a frequency of 1 Hz, a positive peak voltage of 130 V, and a negative peak voltage of −50 V is applied between the pair of electrodes 28*a*, 28*b* of the actuator element 14. The displacement amount is continuously measured at respective points (Point A to Point H) by using a laser displacement meter. FIG. 10 shows a bending displacement characteristic obtained by plotting results of the measurement on a graph of electric field-bending displacement. As indicated by arrows in FIG. 10, the displacement amount of the bending displacement continuously changes in accordance with continuous increase and decrease in applied voltage while providing a certain degree of hysteresis.

Specifically, at first, it is assumed that the measurement is started from a no-voltage-loaded state (applied voltage=0 V) indicated by Point B. At Point B, only a uniform electric field, which is caused by the polarization treatment, is generated in the shape-retaining layer 26. Therefore, no elongation occurs in the shape-retaining layer 26, and the displacement-transmitting section 32 and the optical waveguide plate 12 are in a separated state, i.e., in the OFF state.

Next, when the positive peak voltage (=130 V) is applied between the pair of electrodes 28*a*, 28*b* of the actuator element 14, then as shown by Point A, the direction of polarization in the shape-retaining layer 26 is coincident with the direction of the electric field brought about by the applied voltage, and the electric field is applied intensely in the vicinity of the surface of the shape-retaining layer 26. Therefore, the shape-retaining layer 26 is elongated in the horizontal direction, and the actuator element 14 makes bending displacement in the first direction (the direction to make approach to the optical waveguide plate 12). The convex displacement of the actuator element 14 allows the displacement-transmitting section 32 to make displacement toward the optical waveguide plate 12, and the displacement-transmitting section 32 contacts with the optical waveguide plate 12.

The displacement-transmitting section 32 contacts with the back surface of the optical waveguide plate 12 in response to the bending displacement of the main actuator element 30. When the displacement-transmitting section 32 contacts with the back surface of the optical waveguide plate 12, for example, the light 10, which has been totally reflected in the optical waveguide plate 12, is transmitted through the back surface of the optical waveguide plate 12, and it is transmitted to the surface of the displacement-transmitting section 32. The light 10 is reflected by the surface of the displacement-transmitting section 32. Accordingly, the picture element corresponding to the actuator element 14 is in the ON state.

The displacement-transmitting section 32 is provided to reflect the light transmitted through the back surface of the optical waveguide plate 12, and it is provided to increase the contact area with respect to the optical waveguide plate 12 to be not less than a predetermined size. That is, the light emission area is determined by the contact area between the displacement-transmitting section 32 and the optical waveguide plate 12.

In the display D described above, the displacement-transmitting section 32 includes the plate member 32*a* for determining the substantial light emission area, and the displacement-transmitting member 32*b* for transmitting the displacement of the main actuator element 30 to the plate member 32*a*.

The contact between the displacement-transmitting section 32 and the optical waveguide plate 12 means the fact that the displacement-transmitting section 32 and the optical waveguide plate 12 are positioned at a distance of not more than the wavelength of the light 10 (light 10 introduced into the optical waveguide plate 12).

It is preferable that portions other than the plate member 32*a* which makes contact with the optical waveguide plate 12 are covered with a black matrix. Especially, it is preferable to use, for example, a metal film such as those made of Cr, Al, Ni, and Ag as the black matrix, because of the following reason. That is, such a metal film absorbs a small amount of light, and hence it is possible to suppress attenuation and scattering of the light transmitted through the optical waveguide plate 12. Therefore, such a metal film is used especially preferably.

Next, when the voltage application to the pair of electrode 28*a*, 28*b* of the actuator element 14 is stopped to give the no-voltage-loaded state, the actuator element 14 intends to make restoration from the convex state to the original state (state indicated by Point B). However, due to the hysteresis characteristic, the actuator element 14 does not undergo complete restoration to the state of Point B, and it gives a state in which it is slightly displaced in the first direction from Point B (state indicated by Point H). In this state, the displacement-transmitting section 32 and the optical waveguide plate 12 are in a state in which they are separated from each other, i.e., in the OFF state.

Next, when the negative peak voltage (−50 V) is applied between the pair of electrode 28*a*, 28*b* of the actuator element 14, then the direction of polarization in the shape-retaining layer 26 is mutually opposite to the direction of the electric field brought about by the voltage application as shown by Point A, and the shape-retaining layer 26 is contracted in the horizontal direction. Accordingly, the slight displacement in the first direction in the no-voltage-loaded state is counteracted, and the actuator element 14 completely makes restoration to the original state.

As also understood from the characteristic curve, the ON state is maintained owing to the memory function (hysteresis characteristic) of the shape-retaining layer 26 even when the applied voltage is lowered, for example, up to 30 V to 80 V after giving the ON state by applying the positive peak voltage between the pair of electrodes 28*a*, 28*b*. The memory function is also effected in the OFF state in the same manner as described above. The OFF state is maintained owing to the memory function (hysteresis characteristic) of the shape-retaining layer 26 even when the applied voltage is raised, for example, up to 30 V to 80 V after giving the OFF state by applying 0 V or the negative peak voltage between the pair of electrodes 28*a*, 28*b*.

That is, the actuator element 14 having the shape-retaining layer 26 can be defined as an actuator element which has at least two or more displacement states at an identical voltage level.

The actuator element 14 having the shape-retaining layer 26 has the following features.

(1) The threshold characteristic concerning the change from the OFF state to the ON state is steep as compared with the case in which no shape-retaining layer 26 exists. Accordingly, it is possible to narrow the deflection width of the voltage, and it is possible to mitigate the load on the circuit.

(2) The difference between the ON state and the OFF state is distinct, resulting in improvement in contrast.

(3) The dispersion of threshold value is decreased, and an enough margin is provided for the voltage setting range.

It is desirable to use, as the actuator element 14, an actuator element 14 which makes, for example, upward displacement (giving the separated state upon no voltage load and giving the contact state upon voltage application) because of easiness of control. Especially, it is desirable to use the structure having the pair of electrodes 28*a*, 28*b* on the surface.

Explanation of Driving Device

Figure 11:
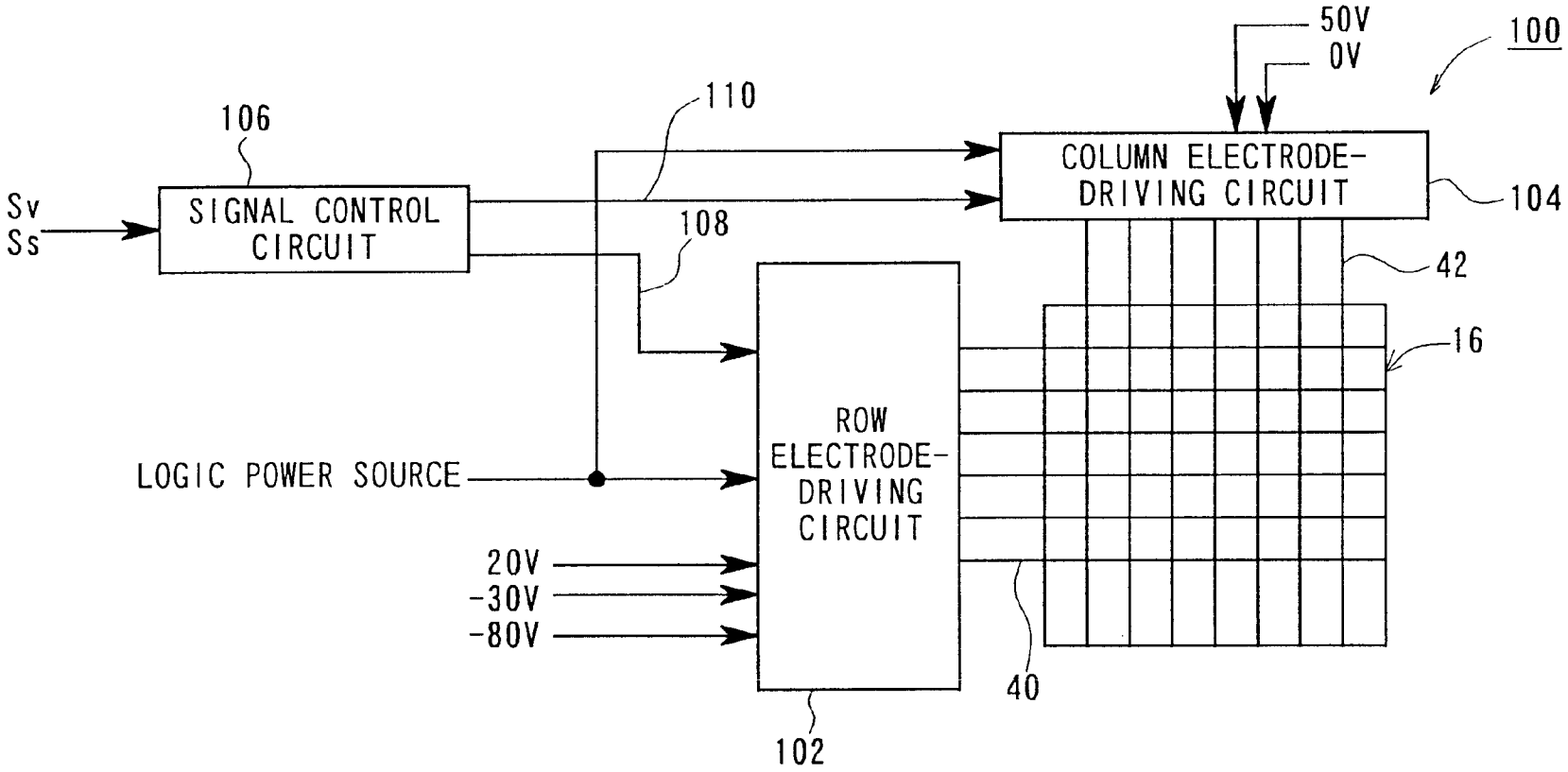
FIG. 11 shows an arrangement of the driving device according to the embodiment of the present invention.

Next, explanation will be made for a driving device 100 according to the embodiment of the present invention with reference to FIG. 11. The driving device 100 comprises a row electrode-driving circuit for selectively supplying a driving signal to the vertical selection lines 40 (connected in series to the row electrodes 28*a* of the actuator elements 14 for the respective rows) for the display section 16 comprising a large number of actuator elements 14 arranged in the matrix configuration or in the zigzag configuration so that the actuator elements 14 are successively selected in one row unit, a column electrode-driving circuit 104 for outputting a data signal in parallel to the signal lines 42 for the display section 16 so that the data signal is supplied to the column electrodes 28*b* of the respective actuator elements 14 on the line (selected line) selected by the row electrode-driving circuit 102 respectively, and a signal control circuit 106 for controlling the row electrode-driving circuit 102 and the column electrode-driving circuit 104 on the basis of a picture image signal Sv and a synchronization signal Ss to be inputted.

A logic power source voltage (for example, ±5 V) for logical operation performed in an internal logic circuit, and three types of row side power source voltages (for example, 20 V, −30 V, and −80 V) are supplied to the row electrode-driving circuit 102 by the aid of an unillustrated power source circuit. The logic power source voltage and two types of column side power source voltages (for example, 50 V and 0 V) are supplied to the column electrode-driving circuit 104 by the aid of the unillustrated power source circuit.

The signal control circuit 106 comprises, at its inside, a timing controller, a frame memory, and an I/O buffer, which is constructed such that the row electrode-driving circuit 102 and the column electrode-driving circuit 104 are subjected to gradation control on the basis of the temporal modulation system via a row side control line 108 communicating with the row electrode-driving circuit 102 and a column side control line 110 communicating with the column electrode-driving circuit 104.

It is desirable that the row electrode-driving circuit 102 and the column electrode-driving circuit 104 have the following features.

(1) The actuator element undergoes the capacitive load. Therefore, considering the fact that the capacitive load is subjected to the driving, for example, it is desirable that the partial voltage ratio, which is applied to the capacitive load, is not less than 50% at the time of completion of voltage (ON voltage) application for allowing the actuator element 14 to make the bending displacement.

(2) In order to obtain an displacement amount of the actuator element 14 which makes it possible to express the ON state and the OFF state of the picture element, it is desirable that an voltage output of not less than 20 V can be provided.

(3) It is desirable to consider the fact that the direction of the output current is recognized to be bidirectional.

(4) It is desirable that the load concerning the two-electrode structure in the row direction and the column direction can be subjected to the driving.

Explanation of Gradation Control Based on Temporal Modulation System According to the Embodiment of the Present Invention The gradation control based on the temporal modulation system according to the embodiment of the present invention will now be explained with reference to FIGS. 12 to 20. At first, the display period for one image is assumed to be one field. Those set for the one field include a period (hereinafter referred to as "light source turn on period") Tb for radiating the light from the light source to the optical waveguide plate 12 shown in FIG. 1, and a period (hereinafter referred to as "light source turn off period") Tc for stopping the radiation of the light from the light source to the optical waveguide plate 12.

An overall bending displacement period Td for making bending displacement of all of the actuator elements 14 is set within the light source turn off period Tc. A gradational display period Te for performing substantial gradational display, and a reset period TR for resetting the bending displacement of all of the actuator elements 14 (exactly, the actuator elements 14 subjected to the bending displacement to allow the corresponding picture elements to emit light over the gradational display period Te) are set within the light source turn on period Tb.

The time, which extends from the point of time of application of a voltage (for example, +130 V) sufficient to make the bending displacement to the actuator element 14 for constructing the picture element until light emission of the picture element as a result of the bending displacement of the actuator element 14, is defined as "light-emitting rising time Tr of the picture element". The time, which extends from the point of time of application of a voltage (for example, −20 V) sufficient to reset the bending displacement to the actuator element 14 until quenching of the picture element as a result of the reset of the bending displacement of the actuator element 14, is defined as "quenching falling time Tf of the picture element".

Figure 12:
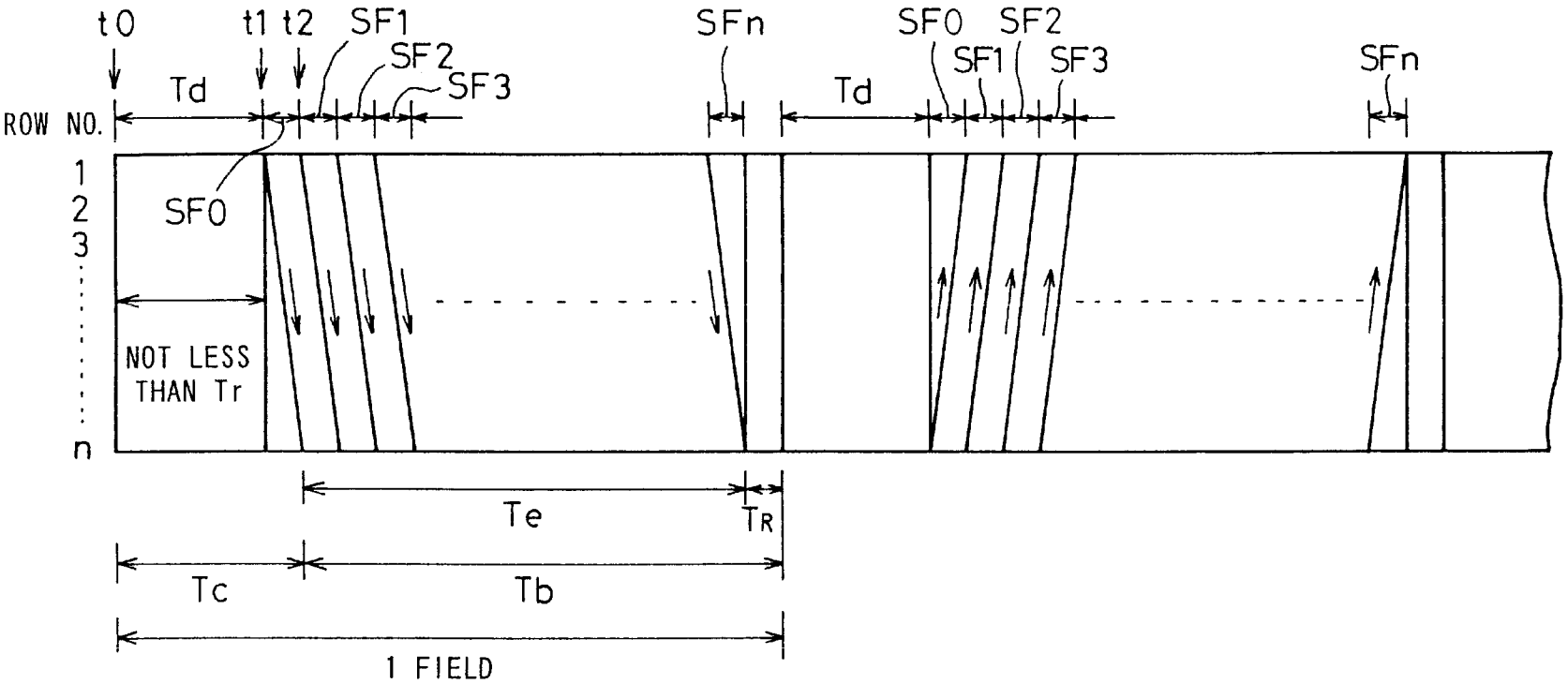
FIG. 12 shows a timing chart illustrating gradation control based on the temporal modulation system, performed in the driving device according to the embodiment of the present invention.

As shown in FIG. 12, as for the driving device 100 according to this embodiment, the overall bending displacement period Td is set, which extends from the start point of time t0 of one field to at least the light-emitting rising time Tr of the picture element or which extends thereover. The light source turn on period Tb (i.e., the gradational display period Te) is started from a point of time t2 after passage of one subfield SF0 from an end point of time t1 of the overall bending displacement period Td.

A number of subfields (SF1 to SFn) corresponding to the maximum gradation level are set in the gradational display period Te. The row electrode-driving circuit 102 is subjected to timing control by the signal control circuit 106 so that all row selection is completed in each of the subfields SF1 to SFn.

Therefore, the time for the row electrode-driving circuit 102 to select one row is regulated by the time width obtained by dividing one subfield by the number of rows of the driving section 16. The time width described above or a time shorter than the time width is selected. Preferably, 1/n of the time width (n is an arbitrary real number from 1 to 5, preferably a real number from 1 to 3) is selected. The time for selecting one row by using the row electrode-driving circuit 102 corresponds to the time for switching the address for the driving section 16. Therefore, the foregoing time may be defined as "address time Ta".

Figure 13:
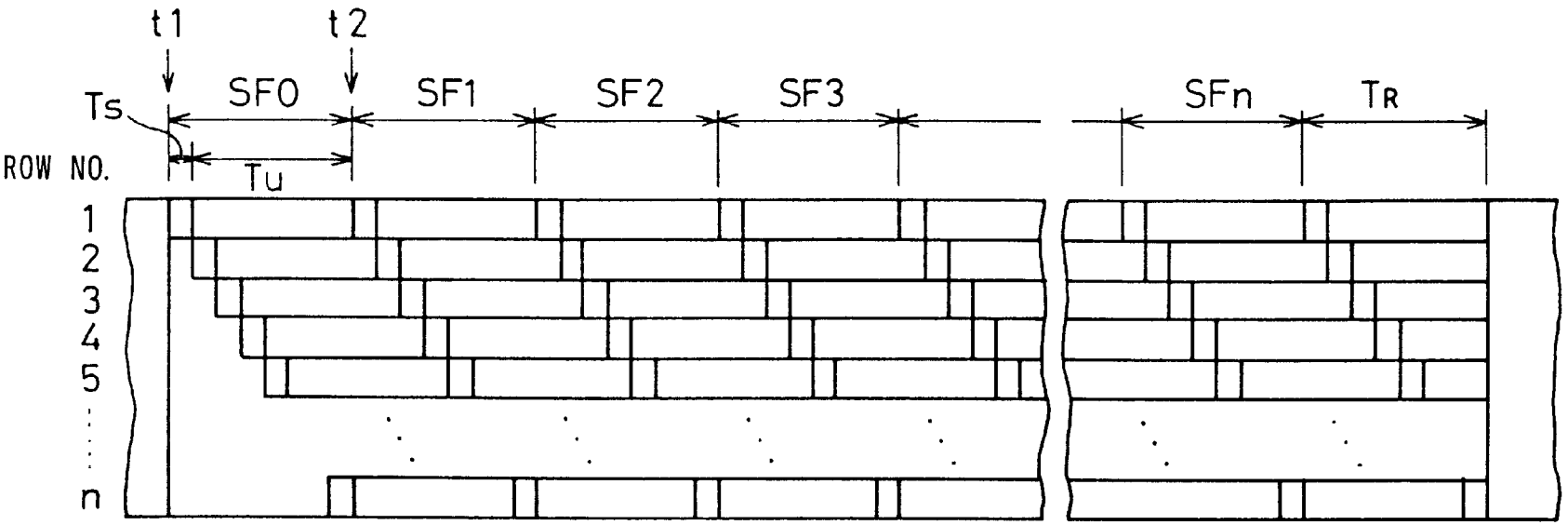
FIG. 13 shows a timing chart illustrating the gradational display period and the reset period in the light source turn on period.

As shown in FIG. 13, in the driving device 100 according to the embodiment of the present invention, each of the subfields is divided into a selection period Ts and an unselection period Tu. In this embodiment, the selection period Ts is set to be the same period of time as the address time Ta described above. The reset period $T_R$ is a period corresponding to one subfield.

In this embodiment, the signal control circuit 106 is used to prepare a data signal for each picture element concerning the selected row by allotting the display time corresponding to each gradation level to each of the subfields SF1 to SFn. The data signal is outputted during the selection period Ts of each of the subfields SF1 to SFn by the aid of the column electrode-driving circuit 104.

Accordingly, for example, when the overall bending displacement period Td is completed, the group of picture elements in the first row are selected by the row electrode-driving circuit 102. The data signal is supplied to the group of picture elements in the first row by the aid of the column electrode-driving circuit 104. The data signal, which is supplied to each of the picture elements, is the data signal (for example, the ON signal and the OFF signal) prepared by allotting the display time corresponding to the gradation level to each of the subfields SF0 to SFn. When observation is made for one picture element, the display time corresponding to the gradation level of the picture element is assigned to the time width allotted to each of the subfields SF0 to SFn. This procedure includes a case in which the assignment is made for all of the subfields SF0 to SFn, and a case in which the assignment is made for some of the subfields.

For example, it is assumed that the number of subfields is 10 (in this case, there are subfields SF0 to SF9). When the picture element has 10 gradation levels, for example, all of the subfields SF0 to SF9 are selected. When the gradation level is 6, the continuous subfields SF0 to SF5 are selected. When the gradation level is 3, the continuous subfields SF0 to SF2 are selected.

The output form of the data signal supplied to the picture element is as follows. That is, for example, it is possible to adopt a form in which the ON signal is outputted for the selected subfield, and the OFF signal is outputted for the unselected subfield.

Figures 14, 15:
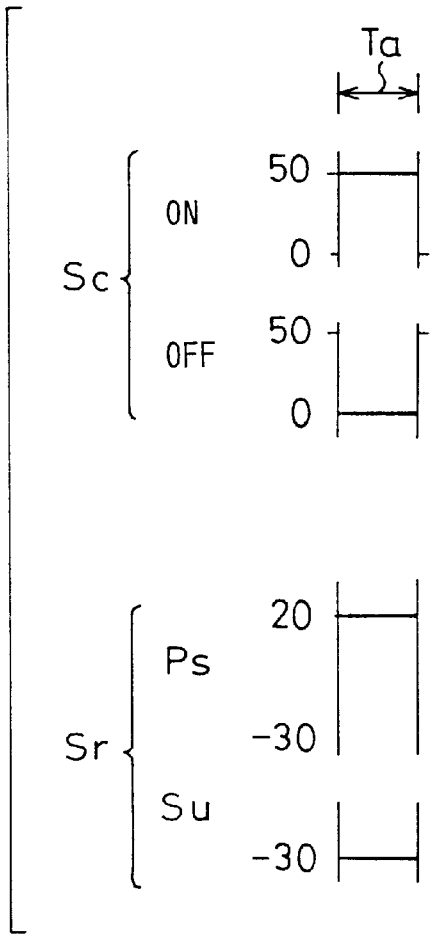
FIG. 14 illustrates a picture element group and the contents of gradation levels of respective picture elements referred to in the first and second embodiments.
FIG. 15 illustrates signal forms of a column signal and a row signal concerning a first specified embodiment of the driving device according to the embodiment of the present invention.

Two specified embodiments will now be explained with reference to FIGS. 14 to 20. In order to simplify the explanation for these embodiments, the explanation is directed to only a display pattern (representing four gradation levels) for the picture element in the first column provided that the number of rows is 4 as shown in FIG. 14. Timing charts shown in FIGS. 16A to 16D, FIGS. 18A to 18D, FIGS. 19A to 19C, and FIGS. 20A to 20C illustrate respective waveforms of the column signal Sc for the first column, the row signal Sr for the first row, and the applied voltage Vp to the picture element in the first row first column.

Figure 16A:
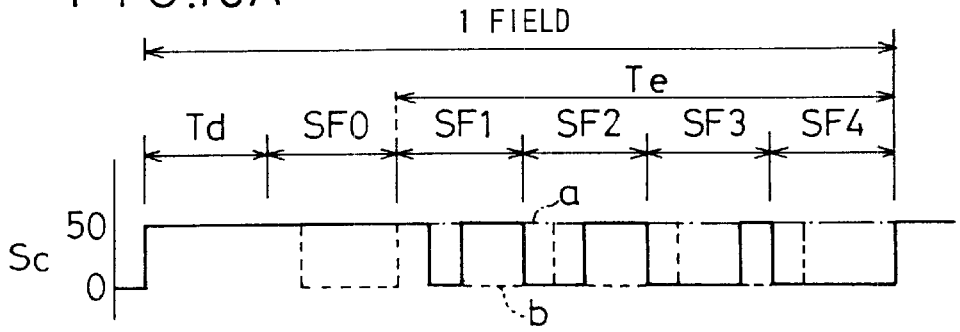
FIG. 16A shows a waveform of the column signal (first column) in the first embodiment.
Figure 16B:
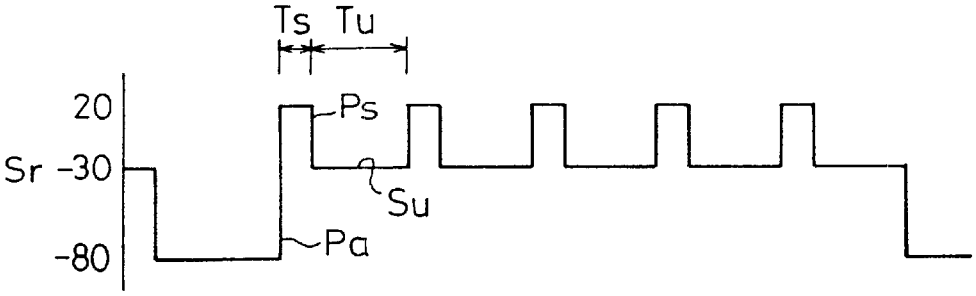
FIG. 16B shows a waveform of the row signal (first row) in the first embodiment.

At first, in the first embodiment, as shown in FIGS. 16A and 16B, the row electrode-driving circuit 102 outputs a bending displacement pulse signal Pa which starts from the start point of time t0 of one field and which extends over the overall bending displacement period Td within the light source turn off period Tc. The row electrode-driving circuit 102 outputs a selection pulse signal Ps during the selection period Ts (address period Ta) in each of the subfields SF0 to SF4 after passage of the overall bending displacement period Td. The row electrode-driving circuit 102 outputs an unselection signal Su during the unselection period Tu in each of the subfields SF0 to SF4.

More specifically, as shown in FIG. 16B, the bending displacement pulse signal Pa has a pulse waveform in which the pulse width is approximately the same as the overall bending displacement period Td and the peak voltage is −80 V. The selection pulse signal Ps has a pulse waveform in which the pulse width is approximately the same as the selection period Ts (address time Ta) and the peak voltage is +20 V. The unselection signal Su is fixed at a reference level (−30 V) (see FIG. 15).

As shown in FIG. 16A, the column electrode-driving circuit 104 outputs the ON signal with a peak voltage of +50 V having the same polarity as that of the selection pulse signal Ps, during the selection period Ts in the subfield allotted as the light emission objective, of the respective subfields SF0 to SF4. The column electrode-driving circuit 104 outputs the OFF signal at 0 V during the selection period Ts in the subfield as the quenching objective.

Figure 16C:
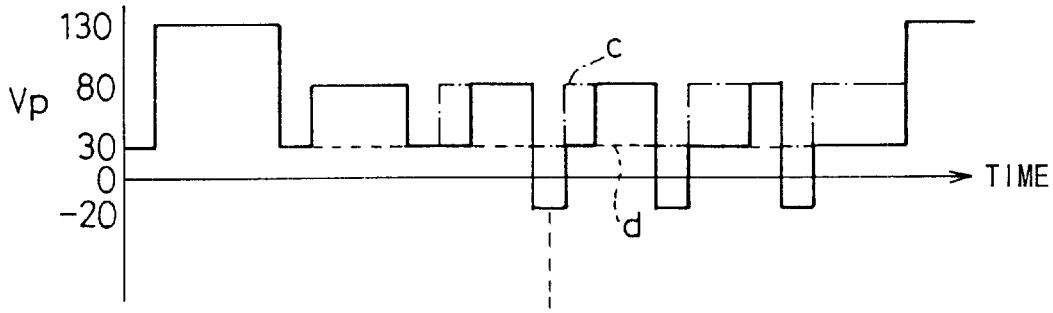
FIG. 16C shows a voltage waveform illustrating a voltage applied to a specified picture element (first row, first column)
Figure 16D:
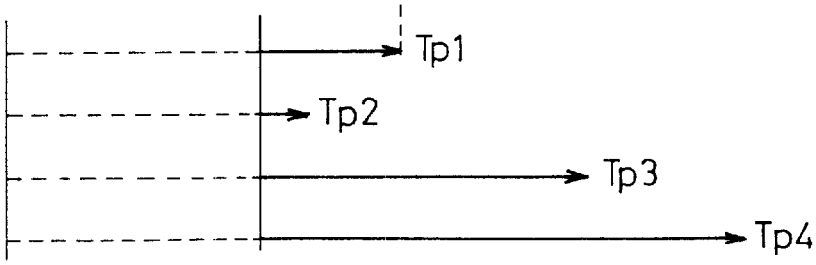
FIG. 16D shows a timing chart illustrating light emission times of respective picture elements.

The column electrode-driving circuit 104 outputs a signal at the same level as that of the ON signal during the overall bending displacement period Td. Therefore, during the overall bending displacement period Td as shown in FIG. 16C, the ON signal (+50 V) is applied to the column electrode 28*b*, and the bending displacement pulse signal (−80 V) is applied to the row electrode 28*a*. Accordingly, the applied voltage Vp between the pair of electrodes 28*a*, 28*b* of the picture element is 130 V. Thus, all of the picture elements are in the ON state according to the bending displacement characteristic shown in FIG. 10. However, no light is introduced from the light source into the optical waveguide plate 12. Therefore, all of the picture elements do not cause any light emission, and all of them are in the quenching state.

This embodiment assumes the case of four-row scanning. Therefore, the temporal length of each of the subfields SF0 to SF4 is, for example, a length corresponding to four address times (4×Ta). Therefore, when observation is made for the picture element in the first row, the selection period Ts is the initial first address time of one subfield (for example, the subfield SF1), and the unselection period Tu is the remaining and continuous second to fourth address times.

It is assumed that when the scanning is performed in one row unit, the selection period Ts is deviated by every one address time Ta. The selection periods Ts for the respective picture elements in the second, third, and fourth row appear at timings corresponding to the second, third, and fourth address times respectively, when the row signal Sr for the first picture element is used as a standard.

As shown in FIG. 14, the gradation level of the picture element in the first row is 2, the gradation level of the picture element in the second row is 1, the gradation level of the picture element in the third row is 3, and the gradation level of the picture element in the fourth row is 4. Therefore, the following signals are outputted as the data signal outputted from column electrode-driving circuit 104. That is, as for the subfield SF0, the ON signal is outputted over the subfield FS0, because all of the picture elements are turned on. As for the subfield SF1, the OFF signal is outputted at the timing of the second address time in the subfield SF1, and the ON signal is outputted during the other period, because it is necessary to turn off only the picture element in the second row. In the subfield SF1, the picture element in the second row is quenched at an approximately middle point of the second address time, and the turn on period Tp2 corresponds to the gradation level=1 (see FIG. 16D).

As for the next subfield SF2, the OFF signal is outputted at the timing of the first and second address times in the subfield SF2, and the ON signal is outputted during the other period, because it is necessary to turn off the picture elements in the first and second rows. In the subfield SF2, the picture element in the first row is quenched at an approximately middle point of the first address time, and the turn on period Tp1 corresponds to the gradation level=2 (see FIG. 16D).

For example, when observation is directed to the picture element in the first row, if the ON signal is outputted during the selection period Ts as in the subfields SF0 and SF1, then the ON signal (+50 V) is applied to the column electrode 28*b* during the selection period Ts, and the selection pulse signal Ps (+20 V) is applied to the row electrode 28*a*. Accordingly, the applied voltage Vp between the pair of electrodes 28*a*, 28*b* of the picture element is +30 V. In this case, as also shown in the bending displacement characteristic in FIG. 10, the actuator element 14 for the concerning picture element undergoes the displacement at +30 V (see Point C), and the bending displacement of the actuator element 14 is maintained as it is. Thus, the concerning picture element is in the ON state. The subfield SF0 is included in the light source turn off period Tc, and hence the quenching state is still maintained even when the picture element is in the ON state. On the other hand, in the subfield SF1, the light source turn on period Tb starts from the start point of time t2 of the subfield SF1, and the light is introduced from the light source into the optical waveguide plate 12. Therefore, the concerning picture element causes light emission.

Next, in the picture element in the first row, when the OFF signal is outputted during the selection period Ts as in the subfield SF2, the OFF signal (0 V) is applied to the column electrode 28*b* during the selection period Ts, and the selection pulse signal Ps (+20 V) is applied to the row electrode 28*a*. Therefore, the applied voltage Vp between the pair of electrodes 28*a*, 28*b* of the concerning picture element is −20 V. Thus, according to the bending displacement characteristic shown in FIG. 10, the bending displacement of the actuator element 14 corresponding to the concerning picture element is reset, and the concerning picture element is in the OFF state and quenched.

As for the subfield SF3, it is necessary to turn on the three picture elements in the first to third rows. Therefore, the OFF signal is continuously outputted at timings of the first to third address times in the subfield SF3, and the ON signal is outputted during the other period, i.e., during the fourth address time. At this point of time, the picture element in the third row is also in the OFF state and quenched. In the subfield SF3, the picture element in the third row is quenched at an approximately middle point of the third address time, and the turn on period Tp3 corresponds to the gradation level=3 (see FIG. 16D).

Next, as for the subfield SF4, it is necessary to turn off all of the picture elements in the first to fourth rows. Therefore, the OFF signal is continuously outputted during the entire period of the subfield SF4. At this point of time, the picture element in the fourth row is also in the OFF state and quenched. That is, all of the picture elements are quenched. In the subfield SF4, the picture element in the fourth row is quenched at an approximately middle point of the fourth address time, and the turn on period Tp4 corresponds to the gradation level=4 (see FIG. 16D).

Thus, the image is displayed on the screen of the display by successively repeating the series of operations described above.

According to the first embodiment as described above, it is unnecessary to perform, for example, complicated voltage switch and voltage selection even when the range of display gradation of each of the picture elements is widened. Therefore, it is possible to suppress the setting number of working voltages to the minimum.

As shown in FIG. 10, the actuator element 14 for constructing each of the picture elements has the memory function for the bending displacement. However, in the driving device 100 according to the embodiment of the present invention, the peak value of the pulse signal for the row selection is a voltage value at which the actuator element 14 sufficiently makes the bending displacement in the first direction, and the voltage value during the unselection period Tu thereafter is set within a range in which the actuator element 14 is capable of storing the. displacement.

Therefore, it is possible to easily control the actuator element 14 in accordance with the temporal modulation system. Further, the voltage value during the unselection period Tu is set to be the voltage value described above (voltage value within the range in which the actuator element 14 is capable of storing the displacement). Therefore, the selection period Ts can be made further short, for example, it can be made short up to the address time Ta.

In general, the light-emitting rising time Tr of the picture element is sometimes extremely longer than the quenching falling time Tf of the picture element. In such a case, it is necessary for each of the subfields to set the delay time until light emission of the picture element (i.e., the light-emitting rising time Tr of the picture element). Such a procedure causes a problem that the time of the gradational display period Te to make contribution to light emission is shortened, and it is disadvantageous to extend the gradation level.

However, in the display-driving device 100 according to the first embodiment, all of the actuator elements 14 are subjected to the bending displacement during the light source turn off period Tc before the start of the gradational display period Te. Therefore, the light emission is performed for the period of time corresponding to the gradation level of each of the picture elements in the next gradational display period Te. After that, the bending displacement of the actuator element 14 corresponding to the picture element is reset to successfully turn off the picture element. Accordingly, it is unnecessary to set any preparatory period (delay time) for making the bending displacement of the actuator element 14 during the gradational display period Te. This results in maximum utilization of the limited gradational display period Te, making it possible to obtain an effect of advantage to extend the gradation level of the picture element.

By the way, it is necessary during the unselection period Tu that the state of bending displacement of the actuator element 14 is maintained as it is. Therefore, ideally, it is desirable to apply a fixed electric potential in a degree in which the bending displacement of the actuator element 14 is not affected thereby during the unselection period Tu.

However, in each of the subfields, all of the row selection is completed. Therefore, the data signal for another row (ON signal and OFF signal) successively appears during the unselection period Tu for each of the subfields. That is, as for one picture element, the voltage waveform of the concerning picture element during the unselection period Tu is determined depending on the pattern of the data signal (appearance pattern of the ON signal and the OFF signal) for the rows other than the row to which the concerning picture element belongs in the column to which the concerning picture element belongs.

At first, as shown by a chain line "a" in FIG. 16A, for example, when the ON signal is outputted for all of the rows except for the row (first row) including the picture element in the first row and first column, the average voltage of the concerning picture element during the unselection period Tu is fixed at a voltage level (conveniently referred to as "high voltage level (80 V)") obtained by subtracting the reference level (−30 V) from the voltage level (50 V) of the ON signal as shown by a chain line "c" in FIG. 16C.

Next, as shown by a broken line "b" in FIG. 16A, when the OFF signal is outputted for all of the rows except for the row (first row) including the concerning picture element, the average voltage is fixed at a voltage level (conveniently referred to as "low voltage level (30 V)") obtained by subtracting the reference level (−30 V) from the voltage level (0 V) of the OFF signal as shown by a broken line "d" in FIG. 16C.

Therefore, in this situation, there is a difference of 50 V between the average voltage of 80 V during the unselection period obtained when the ON signal is outputted for all of the other rows and the average voltage of 30 V obtained when the OFF signal is outputted for all of the other rows.

When the ON signal and the OFF signal are alternately outputted in the unit of row for all of the rows except for the row (first row) including the concerning picture element, the average voltage is an intermediate voltage between the high voltage level (80 V) and the low voltage level (30 V).

As a result, the bending displacement of the actuator element 14 during the unselection period Tu is delicately changed depending on the voltage change (voltage change depending on the pattern of the ON signal and the OFF signal). Especially, when the ON signal or the OFF signal is outputted for a cluster of a large number of rows, the difference in average voltage is large. Therefore, there is a possibility that the display state (brightness and gradation) of the concerning picture element during the unselection period Tu may become unstable.

The second embodiment described below resides in a system to solve the problem described above, in which phase information is added to the ON signal, the OFF signal, and the selection pulse signal Ps. The second embodiment is also directed to only the display pattern of the picture elements in the first column with the number of four rows (representing the four gradation levels), in the same manner as the first embodiment described above. It is assumed that the gradation level of the picture element in the first row is 2, the gradation level of the picture element in the second row is 1, the gradation level of the picture element in the third row is 3, and the gradation level of the picture element in the fourth row is 4 (see FIG. 14).

Figure 17:
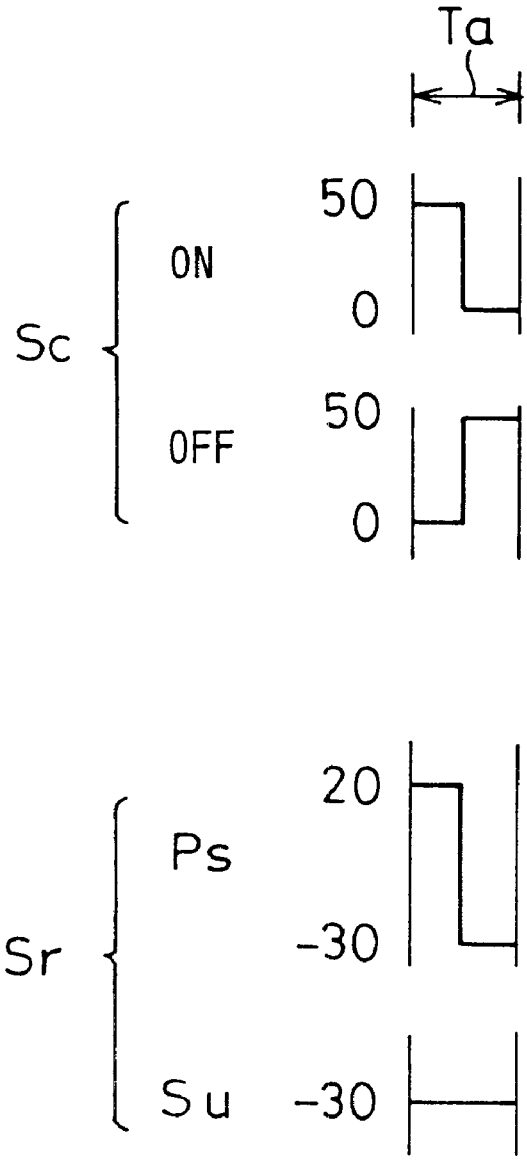
FIG. 17 illustrates signal forms of a column signal and a row signal concerning a second specified embodiment of the driving device according to the embodiment of the present invention.
Figure 18A:
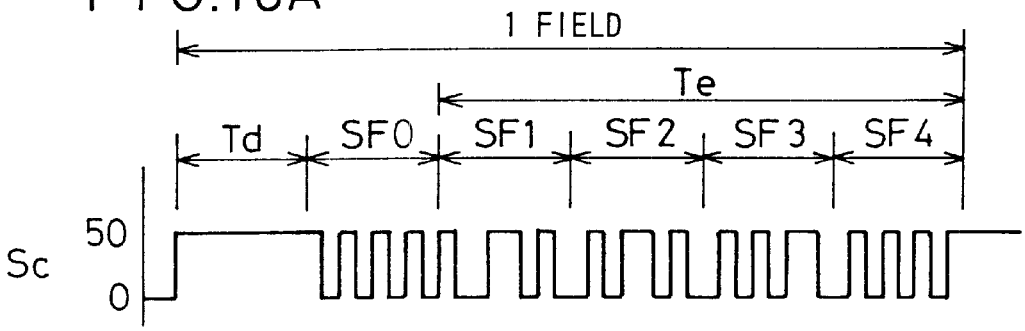
FIG. 18A shows a waveform of the column signal (first column) in the second embodiment.
Figure 18B:
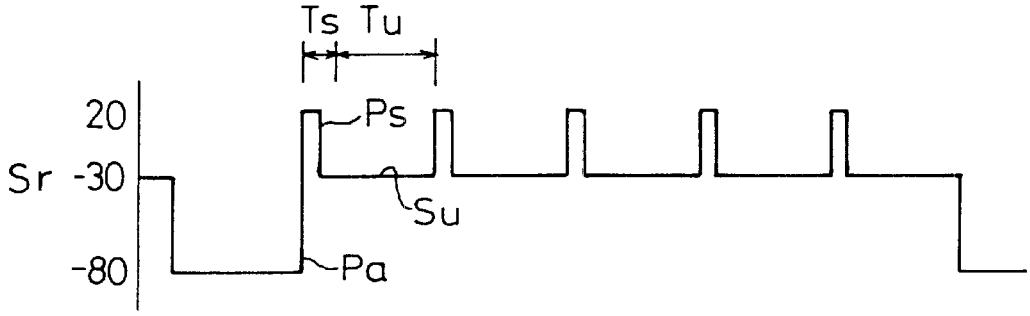
FIG. 18B shows a waveform of the row signal (first row) in the second embodiment.
Figure 18C:
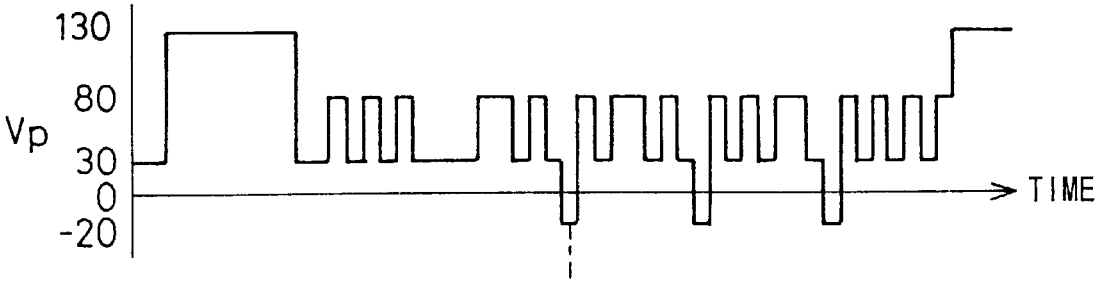
FIG. 18C shows a voltage waveform illustrating a voltage applied to a specified picture element (first row, first column)
Figure 18D:
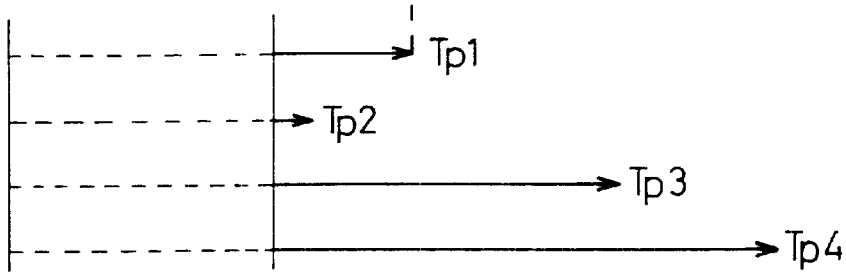
FIG. 18D shows a timing chart illustrating light emission times of respective picture elements.
Figure 19A:
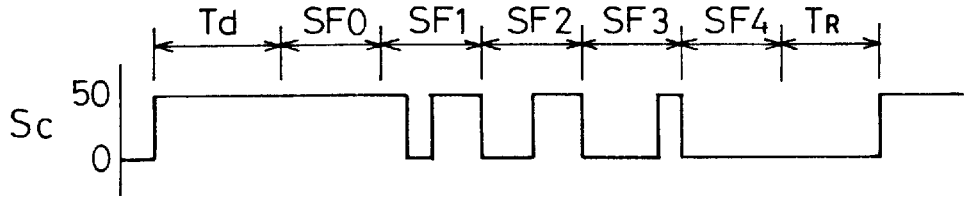
FIG. 19A shows a waveform of a column signal (first column) used when the reset period is included in the first embodiment.
Figure 19B:
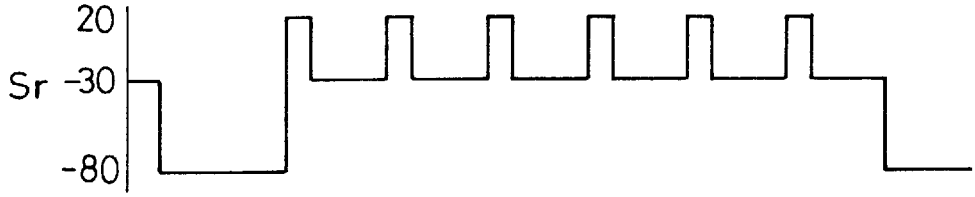
FIG. 19B shows a waveform of a row signal (first row) used when the reset period is included in the first embodiment.
Figure 19C:
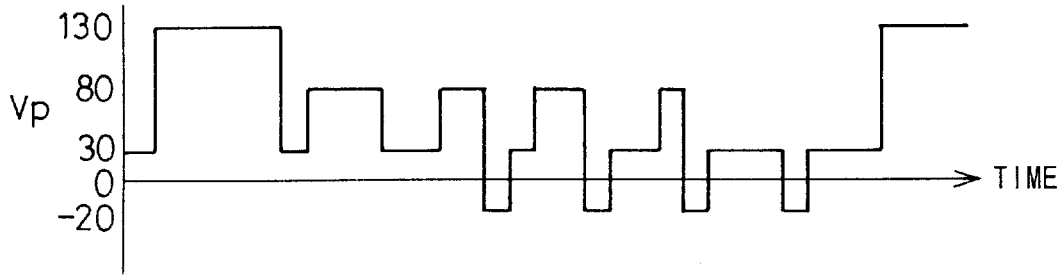
FIG. 19C shows a voltage waveform illustrating a voltage applied to a specified picture element (first row, first column)
Figure 20A:
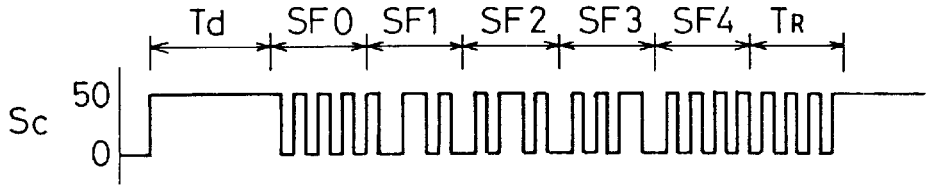
FIG. 20A shows a waveform of a column signal (first column) used when the reset period is included in the second embodiment.
Figure 20B:
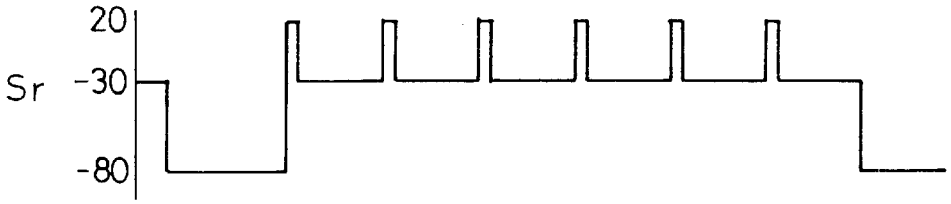
FIG. 20B shows a waveform of a row signal (first row) used when the reset period is included in the second embodiment.
Figure 20C:
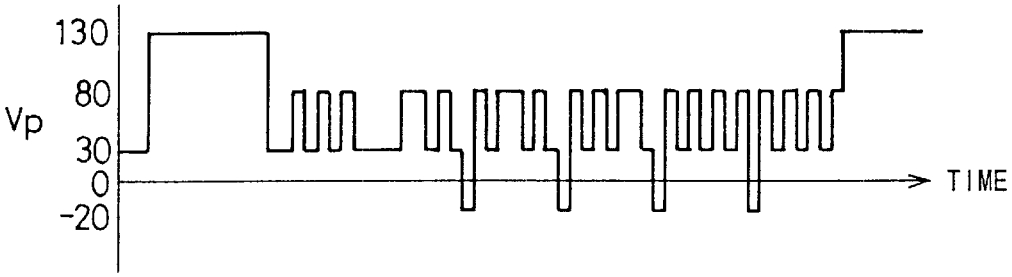
FIG. 20C shows a voltage waveform illustrating a voltage applied to a specified picture element (first row, first column)

As shown in FIG. 17, the second embodiment resides in the system in which the phase information is added to the ON signal, the OFF signal, and the selection pulse signal Ps respectively. In this embodiment, the ON signal has a waveform in which it rises simultaneously with the start of the selection period Ts, and it has a pulse width which is ½ of the address time Ta. The OFF signal has a phase opposite to that of the ON signal. The selection pulse signal Ps has the same phase as that of the ON signal. The output timing of the unselection signal Su is the same as that of the first embodiment.

That is, each of the ON signal, the OFF signal, and the selection pulse signal Ps constitutes a pulse signal in which the high level and the low level exist in a mixed manner within one address time Ta. The signal-processing operation performed in the second embodiment is the same as that performed in the first embodiment. Therefore, detailed explanation thereof will be omitted.

Also in this embodiment, the pulse signal having its amplitude of (high voltage level (80 V)−low voltage level (30 V)) continuously appears during the unselection period Tu of the concerning picture element, for example, when the ON signal is outputted for all of the rows except for the row (first row) including the picture element in the first row and first column, and when the OFF signal is outputted for all of the other rows.

Therefore, both of the average voltages during the unselection period Tu are 55 V for the case in which the ON signal is outputted for all of the other rows and the case in which the OFF signal is outputted for all of the other rows. The difference between these average voltages is 0 V.

As described above, in the second embodiment, the pulse signal continuously appears during the unselection period Tu. Therefore, the average voltage during the unselection period Tu does not depend on the pattern of the ON signal and the OFF signal, and it has an approximately constant value. Thus, the display state (brightness and gradation) is stabilized during the unselection period Tu.

In this embodiment, the waveform of the selection pulse signal Ps is the waveform having the same phase as that of the ON signal. However, it is also preferable to adopt a pulse waveform which is narrower or wider than the pulse width of the ON signal. That is, it is preferable to adopt a form of window pulse.

In the same manner as the first embodiment described above, the second embodiment makes it possible to obtain an effect that the limited gradational display period can be maximally utilized to give an advantage to extend the gradation level of the picture element even when the light-emitting rising time Tr of the picture element is extremely longer than the quenching falling time Tf of the picture element.

In the first and second embodiments described above, the subfield SF4 in the light source turn on period Tb determines the gradation level=4, and it simultaneously plays a role of the reset period $T_R$. Therefore, the reset period $T_R$ is not provided between the subfield SF4 and the next field. However, when the number of subfields corresponding to the maximum gradation level is not so large, it is allowable to provide the reset period $T_R$ between the subfield SF4 and the next field, as shown in FIGS. 19A to 19C and FIGS. 20A to 20C. In this embodiment, the OFF signal is outputted over the reset period $T_R$, in the same manner as the subfield SF4. The bending displacement of the actuator element 14 can be reliably reset by providing the reset period $T_R$ as described above, making it possible to easily respond to the display of animation images in the same manner as the first and second embodiments.

Figure 21:
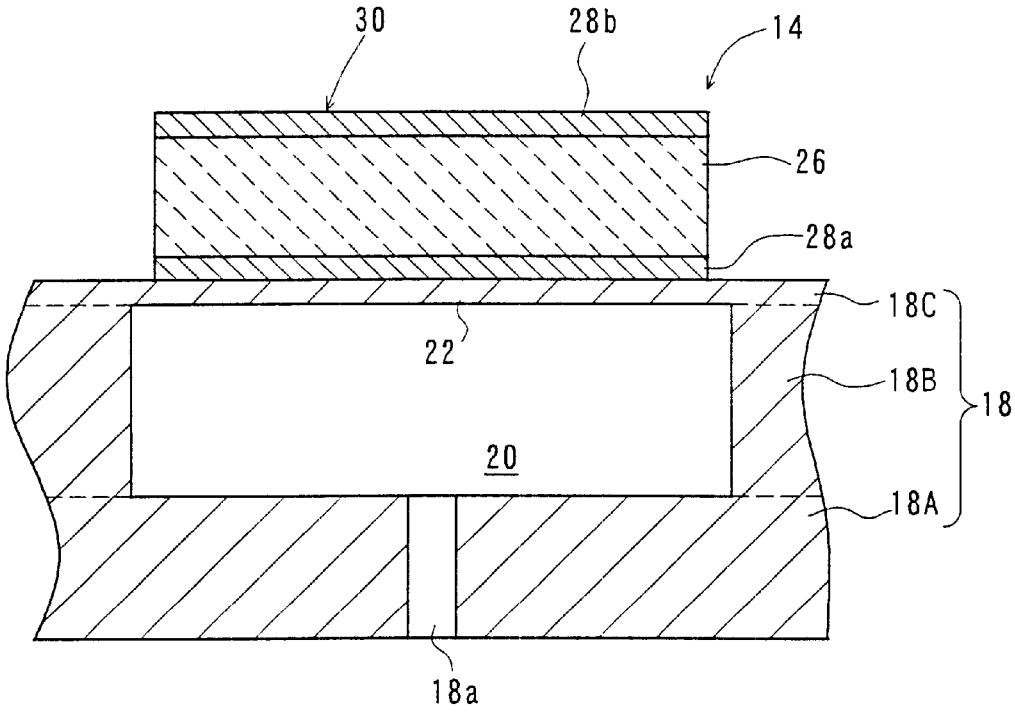
FIG. 21 shows a sectional view illustrating another embodiment of the formation form of the pair of electrodes formed in contact with the shape-retaining layer.

In the first and second embodiments described above, the scanning is performed one after an other from the first row to the fourth row when the picture element array concerning one row is subjected to the scanning. However, as shown in FIG. 12, the scanning may be performed one after another from the first row to the final row in one field (for example, odd number field), and the scanning may be performed one after another from the final row to the first row in the next field (for example, even number field). It is possible to avoid the occurrence of discrepancy corresponding to one gradation between the picture element in the first row and the picture element in the final row, making it possible to improve the image quality. The display D, to which the driving device 100 according to the embodiment is applied, includes the pair of electrodes 28*a*, 28*b* which are formed in such a form that the row electrode 28*a* and the column electrode 28*b* are formed on the surface of the shape-retaining layer 26. Alternatively, as shown in FIG. 21, for example, it is also allowable that the row electrode 28*a* is formed on the lower surface of the shape-retaining layer 26, and the column electrode 28*b* is formed on the upper surface of the shape-retaining layer 26.

The display-driving device and the display-driving method according to the present invention are not limited to the embodiments described above. It is a matter of course that various constructions may be adopted therefor without deviating from the gist or essential characteristics of the present invention.

What is claimed is:

1. A display-driving device for driving a display comprising an optical waveguide plate for introducing light thereinto, and a driving section provided opposingly to one plate surface of said optical waveguide plate and including a number of actuator elements arranged corresponding to a large number of picture elements, for displaying, on said optical waveguide plate, a picture image corresponding to an image signal by controlling leakage light at a predetermined portion of said optical waveguide plate by controlling displacement action of each of said actuator elements in a direction to make contact or separation with respect to said optical waveguide plate in accordance with an attribute of said image signal to be inputted, said display-driving device comprising:

a first driving circuit for selecting said actuator elements at least in one row unit, a second driving circuit for outputting displaying information to said selected row, and a signal control circuit for controlling said first and second driving circuits; wherein:

said first and second driving circuits are controlled to perform gradation control in accordance with a temporal modulation system by using said signal control circuit;

a light source turn on period and a light source turn off period are set within one field provided that a display period for one image is defined as said one field;

an overall bending displacement period for making bending displacement of all of said actuator elements is set within said light source turn off period; and a gradational display period for performing substantial gradational display is set within said light source turn on period.

2. The display-driving device according to claim 1, wherein:

said actuator element of said display comprises a shape-retaining layer, an operating section having at least a pair of electrodes formed in contact with said shape-retaining layer, a vibrating section for supporting said operating section, and a fixed section for supporting said vibrating section in a vibrating manner; and said display comprises a displacement-transmitting section for transmitting said displacement action of said actuator element to said optical waveguide plate, said displacement action being generated by voltage application to said pair of electrodes.

3. The display-driving device according to claim 2, wherein said shape-retaining layer is a piezoelectric/electrostrictive layer.

4. The display-driving device according to claim 2, wherein said shape-retaining layer is an anti-ferroelectric layer.

5. The display-driving device according to claim 1, wherein:

said gradational display period comprises a plurality of subfields;

a selection period and an unselection period are set for each of said subfields, and any of operations of maintenance of light emission/quenching is performed in accordance with a gradation level of said picture element upon selection of said picture element.

6. The display-driving device according to claim 5, wherein:

said first driving circuit is subjected to timing control by said signal control circuit so that all row selection is completed within each of said subfields; and said second driving circuit is subjected to timing control by said signal control circuit so that a data signal, which is prepared by allotting a display time corresponding to each gradation level to an effective display period of each subfield, is outputted during said selection period of each subfield, for each of said picture elements concerning said selected row.

7. The display-driving device according to claim 5, wherein:

a voltage sufficient to maintain said bending displacement of said actuator element is applied to said actuator element corresponding to an objective picture element within said selection period during said operation of maintenance of light emission; and a voltage sufficient to reset said displacement of said actuator element is applied to said actuator element corresponding to said objective picture element within said selection period during said operation of quenching.

8. The display-driving device according to claim 5, wherein a direction for scanning said picture element in each of said subfields is different between said fields adjacent to one another.

9. The display-driving device according to claim 5, wherein at least a reset period for making display brightness to be substantially zero is provided between a certain gradational display period and a gradational display period subsequent thereto.

10. The display-driving device according to claim 5, wherein said first driving circuit is capable of setting at least three voltage levels, and said second driving circuit is capable of setting at least two voltage levels.

11. The display-driving device according to claim 5, wherein:

said first driving circuit outputs a selection pulse signal during said selection period, and it outputs an unselection signal during said unselection period; and said second driving circuit outputs an ON signal during said selection period of a subfield allotted to perform display, of said respective subfields, and it outputs an OFF signal during said selection periods of the other subfields.

12. The display-driving device according to claim 11, wherein:

a voltage sufficient to maintain said bending displacement of said actuator element is applied to said actuator element corresponding to an objective picture element within said output period of said ON signal; and a voltage sufficient to reset said displacement of said actuator element is applied to said actuator element corresponding to said objective picture element within said output period of said OFF signal.

13. The display-driving device according to claim 11, wherein said first driving circuit outputs a selecting window pulse for applying said voltage sufficient to maintain said bending displacement of said actuator element to said actuator element of an objective picture element by means of combination with said ON signal during said selection period.

14. The display-driving device according to claim 11, wherein said first driving circuit outputs a signal for applying said voltage sufficient to reset said displacement of said actuator element to said actuator element of an objective picture element by means of combination with said OFF signal during said selection period.

15. The display-driving device according to claim 11, wherein phase information is added at least to said OFF signal so that a difference in average voltage applied during said unselection period to said actuator element of each of said picture elements is decreased.

16. The display-driving device according to claim 15, wherein said phase information is added to said selection pulse signal and said ON signal and/or said OFF signal respectively.

17. A display-driving method for driving a display comprising an optical waveguide plate for introducing light thereinto, and a driving section provided opposingly to one plate surface of said optical waveguide plate and including a number of actuator elements arranged corresponding to a large number of picture elements, for displaying, on said optical waveguide plate, a picture image corresponding to an image signal by controlling leakage light at a predetermined portion of said optical waveguide plate by controlling displacement action of each of said actuator elements in a direction to make contact or separation with respect to said optical waveguide plate in accordance with an attribute of said image signal to be inputted, said display-driving method comprising said steps of:

selecting said actuator elements at least in one row unit;

outputting displaying information to said selected row; and making gradation control for each of said picture elements in accordance with a temporal modulation system, wherein:

a light source turn on period and a light source turn off period are set within one field provided that a display period for one image is defined as said one field;

an overall bending displacement period for making bending displacement of all of said actuator elements is set within said light source turn off period; and a gradational display period for performing substantial gradational display is set within said light source turn on period.

18. The display-driving method according to claim 17, wherein:

said gradational display period comprises a plurality of subfields;

a selection period and an unselection period are set for each of said subfields; and any of operations of maintenance of light emission/quenching is performed in accordance with a gradation level of said picture element upon selection of said picture element.

19. The display-driving method according to claim 18, wherein:

timing control is performed so that all row selection is completed within each of said subfields; and a data signal, which is prepared by allotting a display time corresponding to each gradation level to an effective display period of each subfield, is outputted during said selection period of each subfield, for each of said picture elements concerning said selected row.

20. The display-driving method according to claim 18, wherein:

a voltage sufficient to maintain said bending displacement of said actuator element is applied to said actuator element corresponding to an objective picture element within said selection period during said operation of maintenance of light emission; and a voltage sufficient to reset said displacement of said actuator element is applied to said actuator element corresponding to said objective picture element within said selection period during said operation of quenching.

21. The display-driving method according to claim 18, wherein a direction for scanning said picture element in each of said subfields is different between said fields adjacent to one another.

22. The display-driving method according to claim 18, wherein at least a reset period for making display brightness to be substantially zero is provided between a certain gradational display period and a gradational display period subsequent thereto.

23. The display-driving method according to claim 18, wherein at least three voltage levels are capable of being set upon said selection of said row, and at least two voltage levels are capable of being set upon said output of said displaying information.

24. The display-driving method according to claim 18, wherein:

upon said selection of said row, a selection pulse signal is outputted during said selection period, and an unselection signal is outputted during said unselection period; and upon said output of said displaying information, an ON signal is outputted during said selection period of an allotted subfield of said respective subfields, and an OFF signal is outputted during said selection periods of the other subfields.

25. The display-driving method according to claim 24, wherein:

a voltage sufficient to maintain said bending displacement of said actuator element is applied to said actuator element corresponding to an objective picture element within said output period of said ON signal; and a voltage sufficient to reset said displacement of said actuator element is applied to said actuator element corresponding to said objective picture element within said output period of said OFF signal.

26. The display-driving method according to claim 24, wherein a selecting window pulse for applying said voltage sufficient to maintain said bending displacement of said actuator element is outputted to said actuator element of an objective picture element by means of combination with said ON signal during said selection period.

27. The display-driving method according to claim 24, wherein a signal for applying said voltage sufficient to reset said bending displacement of said actuator element is outputted to said actuator element of an objective picture element by means of combination with said OFF signal during said selection period.

28. The display-driving method according to claim 24, wherein phase information is added at least to said OFF signal so that a difference in average voltage applied during said unselection period to said actuator element of each of said picture elements is decreased.

29. The display-driving method according to claim 28, wherein said phase information is added to said selection pulse signal and said ON signal and/or said OFF signal respectively.

* * * * *